US008545316B2

(12) United States Patent
Pawloski et al.

(10) Patent No.: US 8,545,316 B2
(45) Date of Patent: Oct. 1, 2013

(54) GAMING SYSTEM AND METHOD FOR PROVIDING A PROGRESSIVE AWARD MULTIPLE TIMES BEFORE RESETTING THE DISPLAYED VALUE OF THE PROVIDED PROGRESSIVE AWARD

(75) Inventors: Jason P. Pawloski, Reno, NV (US); Rogelio S. Decasa, Sparks, NV (US); William K. Hughes, Reno, NV (US); Eric S. Boese, Sparks, NV (US); Jeffrey D. Urmston, Reno, NV (US)

(73) Assignee: IGT, Reno, NV (US)

( * ) Notice: Subject to any disclaimer, the term of this patent is extended or adjusted under 35 U.S.C. 154(b) by 39 days.

(21) Appl. No.: 13/432,468

(22) Filed: Mar. 28, 2012

(65) Prior Publication Data

US 2012/0184365 A1 Jul. 19, 2012

Related U.S. Application Data

(63) Continuation of application No. 12/423,489, filed on Apr. 14, 2009, now Pat. No. 8,157,646.

(51) Int. Cl.
*A63F 9/24* (2006.01)

(52) U.S. Cl.
USPC ..... 463/27; 463/26; 463/28

(58) Field of Classification Search
USPC ..... 463/26–28
See application file for complete search history.

(56) References Cited

U.S. PATENT DOCUMENTS

| | | | |
|---|---|---|---|
| 5,280,909 | A | 1/1994 | Tracy |
| 5,344,144 | A | 9/1994 | Canon |
| 5,364,104 | A | 11/1994 | Jones et al. |
| 5,377,973 | A | 1/1995 | Jones et al. |
| 5,564,700 | A | 10/1996 | Celona |
| 5,655,961 | A | 8/1997 | Acres et al. |
| 5,752,882 | A | 5/1998 | Acres |
| 5,885,158 | A | 3/1999 | Torango et al. |
| 6,089,980 | A | 7/2000 | Gauselmann |
| 6,102,402 | A | 8/2000 | Scott et al. |
| 6,110,043 | A | 8/2000 | Olsen |
| 6,146,273 | A | 11/2000 | Olsen |
| 6,206,782 | B1 | 3/2001 | Walker et al. |
| 6,210,275 | B1 | 4/2001 | Olsen |

(Continued)

FOREIGN PATENT DOCUMENTS

| | | |
|---|---|---|
| WO | 2004/033055 | 4/2004 |
| WO | 2005/036328 | 4/2005 |

(Continued)

*Primary Examiner* — Yu-Hsi D Sun

(74) *Attorney, Agent, or Firm* — Neal, Gerber & Eisenberg LLP

(57) ABSTRACT

In various embodiments, the gaming system and method disclosed herein maintains a progressive award that is associated with a plurality of different progressive award trigger values or progressive award hit values. In such embodiments, the displayed value of the progressive award does not reset to a reset value or reset amount until the displayed value of that progressive award has incremented to each of the plurality of progressive award hit values associated with that progressive award. In these embodiments, the gaming system provides a plurality of displayed incremented values of a progressive award a plurality of times before the displayed value of that progressive award is reset to the reset value. Such a configuration provides that after the gaming system provides a currently displayed value of a progressive award to a player at least a first time, the displayed value of that progressive award continues incrementing from the provided value.

28 Claims, 11 Drawing Sheets

(56) References Cited

U.S. PATENT DOCUMENTS

| | | | | |
|---|---|---|---|---|
| 6,241,608 | B1 | 6/2001 | Torango | |
| 6,319,125 | B1 | 11/2001 | Acres | |
| 6,358,149 | B1 | 3/2002 | Schneider et al. | |
| 6,413,161 | B1 | 7/2002 | Baerlocher et al. | |
| 6,416,409 | B1 | 7/2002 | Jordan | |
| 6,435,511 | B1 | 8/2002 | Vancura et al. | |
| 6,435,968 | B1 | 8/2002 | Torango | |
| 6,439,995 | B1 | 8/2002 | Hughs-Baird et al. | |
| 6,565,434 | B1 | 5/2003 | Acres | |
| 6,585,591 | B1 | 7/2003 | Baerlocher et al. | |
| 6,592,460 | B2 | 7/2003 | Torango | |
| 6,595,854 | B2 | 7/2003 | Hughs-Baird et al. | |
| 6,599,193 | B2 | 7/2003 | Baerlocher et al. | |
| 6,605,001 | B1 | 8/2003 | Tarantino | |
| 6,632,140 | B2 | 10/2003 | Berman et al. | |
| 6,634,943 | B1 | 10/2003 | Baerlocher | |
| 6,634,945 | B2 | 10/2003 | Glavich et al. | |
| 6,656,048 | B2 | 12/2003 | Olsen | |
| 6,712,695 | B2 | 3/2004 | Mothwurf et al. | |
| 6,726,563 | B1 | 4/2004 | Baerlocher et al. | |
| 6,733,386 | B2 | 5/2004 | Cuddy et al. | |
| 6,802,773 | B2 | 10/2004 | Moody | |
| 6,887,154 | B1 | 5/2005 | Luciano, Jr. et al. | |
| 6,910,962 | B2 | 6/2005 | Marks et al. | |
| 6,910,964 | B2 | 6/2005 | Acres | |
| 6,932,701 | B2 | 8/2005 | Glavich et al. | |
| 6,991,538 | B2 | 1/2006 | Cannon | |
| 6,997,804 | B2 | 2/2006 | Berman | |
| 7,056,213 | B2 | 6/2006 | Ching et al. | |
| 7,056,215 | B1 | 6/2006 | Olive | |
| 7,070,505 | B2 | 7/2006 | Vancura et al. | |
| 7,074,127 | B2 | 7/2006 | Cuddy et al. | |
| 7,081,050 | B2 | 7/2006 | Tarantino | |
| 7,090,580 | B2 | 8/2006 | Rodgers et al. | |
| 7,094,148 | B2 | 8/2006 | Baerlocher et al. | |
| 7,108,603 | B2 | 9/2006 | Olive | |
| 7,204,756 | B2 | 4/2007 | Jubinville et al. | |
| 7,273,415 | B2 | 9/2007 | Cregan et al. | |
| 7,291,067 | B2 | 11/2007 | Tarantino | |
| 7,311,598 | B2 | 12/2007 | Kaminkow et al. | |
| 7,311,604 | B2 | 12/2007 | Kaminkow et al. | |
| 7,357,716 | B2 | 4/2008 | Marks et al. | |
| 7,371,169 | B2 | 5/2008 | Baerlocher | |
| 7,371,170 | B2 | 5/2008 | Cregan et al. | |
| 7,393,280 | B2 | 7/2008 | Cannon | |
| 7,427,236 | B2 | 9/2008 | Kaminkow et al. | |
| 7,448,949 | B2 | 11/2008 | Kaminkow et al. | |
| 7,470,184 | B2 | 12/2008 | Baerlocher et al. | |
| 7,481,430 | B1 | 1/2009 | Jackson et al. | |
| 7,500,913 | B2 | 3/2009 | Baerlocher | |
| 7,500,914 | B2 | 3/2009 | Rodgers et al. | |
| 7,500,915 | B2 | 3/2009 | Wolf et al. | |
| 7,530,896 | B2 | 5/2009 | Gauselmann | |
| 7,533,886 | B2 | 5/2009 | Kenney et al. | |
| 7,585,222 | B2 | 9/2009 | Muir | |
| 2001/0004607 | A1* | 6/2001 | Olsen | 463/26 |
| 2002/0151354 | A1 | 10/2002 | Boesen et al. | |
| 2002/0169015 | A1 | 11/2002 | Moody | |
| 2002/0177483 | A1 | 11/2002 | Cannon | |
| 2003/0011127 | A1 | 1/2003 | Vancura et al. | |
| 2003/0092484 | A1 | 5/2003 | Schneider et al. | |
| 2003/0148807 | A1 | 8/2003 | Acres | |
| 2003/0181231 | A1 | 9/2003 | Vancura et al. | |
| 2003/0222402 | A1 | 12/2003 | Olive | |
| 2004/0048644 | A1 | 3/2004 | Gerrard et al. | |
| 2004/0053669 | A1 | 3/2004 | Gerrard et al. | |
| 2004/0063499 | A1 | 4/2004 | Schneider et al. | |
| 2005/0054430 | A1 | 3/2005 | Pitman et al. | |
| 2005/0054436 | A1 | 3/2005 | Frizzell et al. | |
| 2005/0059446 | A1 | 3/2005 | Kaminkow | |
| 2005/0064930 | A1 | 3/2005 | Jubinville et al. | |
| 2005/0119043 | A1 | 6/2005 | Berman et al. | |
| 2005/0119047 | A1 | 6/2005 | Olive | |
| 2005/0176488 | A1 | 8/2005 | Olive | |
| 2005/0209004 | A1 | 9/2005 | Torango | |
| 2005/0239542 | A1 | 10/2005 | Olsen | |
| 2006/0025195 | A1 | 2/2006 | Pennington et al. | |
| 2006/0040723 | A1 | 2/2006 | Baerlocher et al. | |
| 2006/0068882 | A1 | 3/2006 | Baerlocher et al. | |
| 2006/0084494 | A1 | 4/2006 | Belger et al. | |
| 2006/0183535 | A1 | 8/2006 | Marks et al. | |
| 2006/0217170 | A1 | 9/2006 | Roireau | |
| 2006/0258424 | A1 | 11/2006 | Green | |
| 2007/0054733 | A1* | 3/2007 | Baerlocher | 463/27 |
| 2007/0060320 | A1 | 3/2007 | Kelly et al. | |
| 2007/0075497 | A1 | 4/2007 | Friedman | |
| 2007/0077990 | A1 | 4/2007 | Cuddy et al. | |
| 2007/0105619 | A1 | 5/2007 | Kniesteadt et al. | |
| 2007/0105620 | A1 | 5/2007 | Cuddy et al. | |
| 2007/0111786 | A1 | 5/2007 | Snow | |
| 2007/0155485 | A1 | 7/2007 | Cuddy et al. | |
| 2007/0167217 | A1 | 7/2007 | Kaminkow et al. | |
| 2007/0184887 | A1 | 8/2007 | Cannon | |
| 2007/0184896 | A1 | 8/2007 | Dickerson | |
| 2007/0218982 | A1 | 9/2007 | Baerlocher | |
| 2007/0298874 | A1 | 12/2007 | Baerlocher et al. | |
| 2008/0020832 | A1 | 1/2008 | Iddings et al. | |
| 2008/0039191 | A1* | 2/2008 | Cuddy | 463/25 |
| 2008/0076532 | A1 | 3/2008 | Graham et al. | |
| 2008/0076542 | A1 | 3/2008 | Iddings et al. | |
| 2008/0090651 | A1* | 4/2008 | Baerlocher | 463/27 |
| 2008/0102916 | A1 | 5/2008 | Kovacs et al. | |
| 2008/0102920 | A1 | 5/2008 | Baerlocher | |
| 2008/0108401 | A1 | 5/2008 | Baerlocher et al. | |
| 2008/0108410 | A1 | 5/2008 | Baerlocher | |
| 2008/0108412 | A1 | 5/2008 | Snow et al. | |
| 2008/0108423 | A1 | 5/2008 | Benbrahim et al. | |
| 2008/0108429 | A1 | 5/2008 | Davis et al. | |
| 2008/0108430 | A1 | 5/2008 | Evans | |
| 2008/0108431 | A1 | 5/2008 | Cuddy et al. | |
| 2008/0113765 | A1 | 5/2008 | DeWaal | |
| 2008/0113771 | A1 | 5/2008 | Baerlocher et al. | |
| 2008/0113779 | A1 | 5/2008 | Cregan | |
| 2008/0139274 | A1 | 6/2008 | Baerlocher | |
| 2008/0153564 | A1 | 6/2008 | Baerlocher et al. | |
| 2008/0220841 | A1 | 9/2008 | Gagner et al. | |
| 2008/0224402 | A1 | 9/2008 | Snow et al. | |
| 2008/0274790 | A1 | 11/2008 | Cannon | |
| 2008/0277871 | A1 | 11/2008 | Saheki | |
| 2009/0011827 | A1 | 1/2009 | Englman et al. | |
| 2009/0036202 | A1 | 2/2009 | Baerlocher et al. | |
| 2009/0042644 | A1 | 2/2009 | Zielinski | |
| 2009/0042645 | A1 | 2/2009 | Graham et al. | |
| 2009/0088244 | A1 | 4/2009 | Nicely et al. | |
| 2009/0088253 | A1 | 4/2009 | Oberberger et al. | |
| 2009/0093298 | A1 | 4/2009 | Michel | |
| 2009/0111560 | A1 | 4/2009 | Davis et al. | |
| 2009/0111561 | A1 | 4/2009 | Dewaal et al. | |
| 2009/0117970 | A1 | 5/2009 | Dewaal et al. | |
| 2009/0117979 | A1 | 5/2009 | Decasa, Jr. et al. | |
| 2009/0124327 | A1 | 5/2009 | Caputo et al. | |
| 2009/0124362 | A1 | 5/2009 | Cuddy et al. | |
| 2009/0124363 | A1 | 5/2009 | Baerlocher et al. | |
| 2009/0124364 | A1 | 5/2009 | Cuddy et al. | |
| 2009/0124385 | A1 | 5/2009 | Cuddy et al. | |
| 2009/1124320 | | 5/2009 | DeWaal | |

FOREIGN PATENT DOCUMENTS

| | | |
|---|---|---|
| WO | 2005/048157 | 5/2005 |
| WO | 2007/015887 | 2/2007 |
| WO | 2007/024584 | 3/2007 |
| WO | 2007/030733 | 3/2007 |
| WO | 2007/030801 | 3/2007 |
| WO | 2007/087297 | 8/2007 |
| WO | 2007/117502 | 10/2007 |
| WO | 2007/127259 | 11/2007 |

* cited by examiner

FIG. 5

Table 1

| Range | Probability |
|---|---|
| $5.00 <= x < $5.50 | 5% |
| $5.50 <= x < $6.00 | 20% |
| $6.00 <= x < $6.50 | 25% |
| $6.50 <= x < $7.00 | 20% |
| $7.00 <= x < $7.50 | 5% |
| $7.50 <= x < $8.00 | 5% |
| $8.00 <= x < $8.50 | 5% |
| $8.50 <= x < $9.00 | 5% |
| $9.00 <= x < $9.50 | 5% |
| $9.50 <= x < $10.00 | 5% |
| Total | 100% |

Table 2

| Range | Probability |
|---|---|
| $5.00 <= x < $5.50 | 5% |
| $5.50 <= x < $6.00 | 5% |
| $6.00 <= x < $6.50 | 5% |
| $6.50 <= x < $7.00 | 5% |
| $7.00 <= x < $7.50 | 20% |
| $7.50 <= x < $8.00 | 25% |
| $8.00 <= x < $8.50 | 20% |
| $8.50 <= x < $9.00 | 5% |
| $9.00 <= x < $9.50 | 5% |
| $9.50 <= x < $10.00 | 5% |
| Total | 100% |

Table 3

| Range | Probability |
|---|---|
| $5.00 <= x < $5.50 | 5% |
| $5.50 <= x < $6.00 | 5% |
| $6.00 <= x < $6.50 | 5% |
| $6.50 <= x < $7.00 | 5% |
| $7.00 <= x < $7.50 | 5% |
| $7.50 <= x < $8.00 | 5% |
| $8.00 <= x < $8.50 | 5% |
| $8.50 <= x < $9.00 | 20% |
| $9.00 <= x < $9.50 | 25% |
| $9.50 <= x < $10.00 | 20% |
| Total | 100% |

FIG. 6

| Range | | Median | Probability | Average Expected Payout |
|---|---|---|---|---|
| $5.00 | $5.50 | $5.25 | 5.00% | $0.2625 |
| $5.50 | $6.00 | $5.75 | 20.00% | $1.1500 |
| $6.00 | $6.50 | $6.25 | 25.00% | $1.5625 |
| $6.50 | $7.00 | $6.75 | 20.00% | $1.3500 |
| $7.00 | $7.50 | $7.25 | 5.00% | $0.3625 |
| $7.50 | $8.00 | $7.75 | 5.00% | $0.3875 |
| $8.00 | $8.50 | $8.25 | 5.00% | $0.4125 |
| $8.50 | $9.00 | $8.75 | 5.00% | $0.4375 |
| $9.00 | $9.50 | $9.25 | 5.00% | $0.4625 |
| $9.50 | $10.00 | $9.75 | 5.00% | $0.4875 |
| | | Expected Progressive Award Hit Value | | $6.87 |

GAMING SYSTEM AND METHOD FOR PROVIDING A PROGRESSIVE AWARD MULTIPLE TIMES BEFORE RESETTING THE DISPLAYED VALUE OF THE PROVIDED PROGRESSIVE AWARD

PRIORITY CLAIM

This application is a continuation of, claims priority to and the benefit of U.S. patent application Ser. No. 12/423,489, filed on Apr. 14, 2009, the entire contents of which is incorporated by reference herein.

BACKGROUND

Gaming devices which provide players awards in primary or base games are well known. Gaming devices generally require the player to place or make a wager to activate the primary or base game. In many of these gaming devices, the award is based on the player obtaining a winning symbol or symbol combination and on the amount of the wager (e.g., the higher the wager, the higher the award). Symbols or symbol combinations which are less likely to occur usually provide higher awards.

In such known gaming devices, the amount of the wager made on the base game by the player may vary. For instance, the gaming device may enable the player to wager a minimum number of credits, such as one credit (e.g., one penny, nickel, dime, quarter or dollar) up to a maximum number of credits, such as five credits. This wager may be made by the player a single time or multiple times in a single play of the primary game. For instance, a slot game may have one or more paylines and the slot game may enable the player to make a wager on each payline in a single play of the primary game. Thus, it is known that a gaming device, such as a slot game, may enable players to make wagers of substantially different amounts on each play of the primary or base game ranging, for example, from 1 credit up to 125 credits (e.g., 5 credits on each of 25 separate paylines). Accordingly, it should be appreciated that different players play at substantially different wagering amounts or levels and at substantially different rates of play.

Secondary or bonus games are also known in gaming devices. The secondary or bonus games usually provide an additional award to the player. Secondary or bonus games usually do not require an additional wager by the player to be activated. Secondary or bonus games are generally activated or hit upon an occurrence of a designated triggering symbol or triggering symbol combination in the primary or base game. For instance, a bonus symbol occurring on the payline on the third reel of a three reel slot machine may hit the secondary bonus game. Part of the enjoyment and excitement of playing certain gaming devices is the occurrence or triggering of the secondary or bonus game (even before the player knows how much the bonus award will be).

Progressive awards associated with gaming devices are also known. In one form, a progressive award is an award amount which includes an initial amount funded by a casino and an additional amount funded through a portion of each wager made on the progressive gaming device. For example, 0.1% of each wager placed on the primary game of the gaming device associated with the progressive award may be allocated to the progressive award or progressive award fund or pool. The progressive award grows in value as more players play the gaming devices and more portions of these players' wagers are allocated to the progressive award. When a player obtains a winning symbol or symbol combination associated with the progressive award, the accumulated progressive award is provided to the player. After the progressive award is provided to the player, the amount of the next progressive award is reset to the initial value and a portion of each subsequent wager on a gaming device associated with a progressive award is allocated to the next progressive award.

A progressive award may be associated with or otherwise dedicated to a single or stand-alone gaming device. Alternatively, a progressive award may be associated with or otherwise dedicated to multiple gaming devices which each contribute a portion of wagers placed at such gaming device(s) to the progressive award. The multiple gaming devices may be in the same bank of gaming devices, in the same casino or gaming establishment (usually through a local area network ("LAN")) or in two or more different casinos or gaming establishments (usually through a wide area network ("WAN")). Such progressive awards are played for by one or more gaming devices in the same gaming establishment sometimes called local area progressives ("LAP") and such progressive awards played for by a plurality of gaming devices at a plurality of different gaming establishments are sometimes called wide area progressives ("WAP").

Moreover, a gaming device or bank of gaming devices may be simultaneously associated with a plurality of progressive awards. In these multi-level progressive ("MLP") configurations, a plurality of progressive awards start at different award or value levels, such as $10, $100, $1000 and $10,000 and each individually increment or increase until provided to a player. Upon a suitable triggering event at one of more of the gaming devices associated with the MLP, one or more of the progressive awards which form the MLP are provided to one or more of the players at such gaming devices.

While such progressives are popular amongst players, a number of potential problems exist with these known progressive award systems. First, typically only one player wins the progressive award. This may discourage the other players who have also been playing for a long period of time because these players may feel that another progressive award will not hit for a long period of time. Such discouragement can lead to players walking away with jackpot fatigue. Jackpot fatigue can occur when a player no longer finds an award desirable or worth the cost of continuing to play. This desire to quit playing is also due to the fact that a player may feel they must wait a substantial period of time for the jackpot to climb back to a high value. That is, when a progressive award is provided at a different gaming device, a player may feel deflated and not wish to continue playing for a base or reset level progressive award.

In recent years, gaming has become a more social leisure activity. Gaming establishments are now striving for ways to enable players to work together in gaming. Working together creates camaraderie among the players and provides an enhanced gaming experience. Certain secondary or bonus games include a group gaming aspect wherein a plurality of players participate in a group bonus game for one or more bonus awards. There is a continuing need to provide new bonus games which include a group gaming aspect, wherein a plurality of players playing at linked gaming devices participate in a group bonus game for one or more bonus awards.

There is also a continuing need to provide new and different gaming devices and gaming systems as well as new and different ways to provide awards to players including bonus awards.

SUMMARY

In various embodiments, the gaming system and method disclosed herein maintains a progressive award that is associated with a plurality of different progressive award trigger values or progressive award hit values. In such embodiments, the displayed value of the progressive award does not reset to a reset value or reset amount until the displayed value of that progressive award has incremented to each of the plurality of progressive award hit values associated with that progressive award. In other words, in these embodiments, the gaming system provides a plurality of displayed incremented values of a progressive award a plurality of times before the displayed value of that progressive award is reset to a reset value. Such a configuration provides that after the gaming system provides a currently displayed value of a progressive award to a player at least a first time, the displayed value of that progressive award continues incrementing from the provided value. Accordingly, by continuing to increment the displayed value of the progressive award from this provided value (after providing at least the first progressive award to the player), the player and any additional players playing gaming devices in the gaming system do not feel deflated and want to continue to play on those gaming devices.

In one embodiment, the gaming system provides that a progressive award is associated with a plurality of progressive award triggering events before the displayed value of that progressive award is reset to a reset value. In this embodiment, if a progressive award triggering event occurs, the gaming system provides the displayed value of the progressive award to a player and determines if a designated quantity of progressive award triggering events have occurred in association with this progressive award. In one embodiment, if the designated quantity of progressive award triggering events have occurred in association with this progressive award, the displayed value of the progressive award is reset to a reset value. In this embodiment, if the designated quantity of progressive award triggering events have not occurred in association with this progressive award, the displayed value of the progressive award is not reset to a reset value.

In one such embodiment, the gaming system maintains a progressive award that is associated with a plurality of different progressive award hit values. In one embodiment, upon a suitable initiating event, the gaming system randomly determines a plurality of progressive award hit values. In one such embodiment, the plurality of progressive award hit values are associated with a progressive award such that if the displayed value of the progressive award increments to one of these randomly determined progressive award hit values, the gaming system provides the then currently displayed value of the progressive award to the player that placed the wager that caused the displayed value of that progressive award to increment to that progressive award hit value.

In one embodiment, after the gaming system randomly determines each of the plurality of progressive award hit values, the gaming system enables a player to place a wager on a play of a primary game. In one embodiment, after a progressive award increase event occurs, such as a player placing a wager on a play of a game, the gaming system increments the displayed value of the progressive award. The gaming system then determines if the displayed value of the progressive award has incremented to one of the randomly determined progressive award hit values. If the displayed value of the progressive award increments to a first one of the randomly determined progressive award hit values, the gaming system provides the then currently displayed value of the progressive award to the player that placed the wager that caused the displayed value of the progressive award to increment to that randomly determined progressive award hit value.

In one embodiment, after the gaming system provides a then currently displayed value of the progressive award to the player, the gaming system determines if the then currently displayed value of the progressive award is less than at least one of the randomly determined progressive award hit values associated with that progressive award. In one embodiment, if the then currently displayed value of the progressive award is not less than at least one of the randomly determined progressive award hit values associated with the progressive award, the gaming system resets the displayed value of the progressive award to a reset value. On the other hand, if the then currently displayed value of the progressive award is less than at least one of the randomly determined progressive award hit values associated with the progressive award, the gaming system does not reset the displayed value of the progressive award to a reset value. Rather, the gaming system maintains the displayed value of the progressive award and continues incrementing the displayed value of the progressive award from the provided value upon a next suitable progressive award increase event.

For example, a progressive award with a pay range from $1,000.00 to $10,000.00 is associated with a first randomly determined progressive award hit value of $5,356.47, a second randomly determined progressive award hit value of $7,221.26, and a third randomly determined progressive award hit value of $9,812.87. In this example, when the displayed value of the progressive award increments to $5,356.47, the gaming system provides the progressive award value of $5,356.47 to the player who is associated with the progressive award increase event which caused the displayed value of the progressive award to increment to $5,356.47. Since the gaming system determines that $5,356.47 is less than $9,812.87 (i.e., the currently displayed value of the progressive award is less than at least one of the randomly determined progressive award hit values), the gaming system continues incrementing the displayed value of the progressive award from $5,356.47. When the displayed value of the progressive award increments to $7,221.26, the gaming system provides a progressive award value of $7,221.26 to the player who is associated with the progressive award increase event which caused the displayed value of the progressive award to increment to $7,221.26. Since the gaming system determines that $7,221.26 is less than $9,812.87 (i.e., the currently displayed value of the progressive award is less than at least one of the randomly determined progressive award hit values), the gaming system continues incrementing the displayed value of the progressive award from $7,221.26. When the displayed value of the progressive award increments to $9,812.87, the gaming system provides a progressive award value of $9,812.87 to the player who is associated with the progressive award increase event which caused the displayed value of the progressive award to increment to $9,812.87. Since the displayed value of the progressive award is not less than at least one of the randomly determined progressive award hit values, the gaming system resets the displayed value of the progressive award to $1,000.00.

It should be appreciated that, in one embodiment, the gaming system is configured to maintain a plurality of progressive awards, wherein one, a plurality of, or each of the maintained progressive awards is associated with a plurality of progressive award hit values. In this embodiment, a plurality of displayed incremented values of each progressive are provided before the displayed value of each progressive award is reset to a reset value.

In another embodiment, the gaming system simultaneously provides a displayed incremented value of a progressive award to each of a plurality of players. In one such embodiment, if a progressive award triggering event occurs, in addition to providing a currently displayed value of a progressive award to a player who obtains, achieves, or is otherwise associated with the progressive award triggering event, the gaming system also provides the currently displayed value of that progressive award to one or more additional players playing one or more gaming devices in the gaming system. In one embodiment, the gaming system tracks monetary amounts that are designated to be provided as progressive awards. In this embodiment, the gaming system determines a portion of the tracked amounts, wherein the determined portion is based on the quantity of gaming devices that could each potentially provide a progressive award to a player playing that gaming device. The gaming system then displays, to each player playing a gaming device in the gaming system, the determined portion as a current value of the progressive award. For example, if the gaming system designates $1000.00 to potentially be provided as one or more progressive awards, and five gaming devices could each potentially provide a progressive award, the gaming system determines to display $200.00 as the current value of the progressive award (i.e., $1000.00/5=$200.00).

In one embodiment, if a progressive award triggering event occurs, the gaming system determines a quantity of gaming devices to each provide the same currently displayed value of the progressive award. In one embodiment, the gaming system then provides the currently displayed value of the progressive award to each of the players currently playing each of those gaming devices. For example, if the currently displayed value of a progressive award is $200.00 when a progressive award triggering event occurs, and the gaming system determines that five gaming devices in the gaming system are to each provide the currently displayed value of the progressive award as a result of the progressive award triggering event, the gaming system provides $200.00 to each of the players playing those five gaming devices. In this example, by providing the currently displayed value of $200.00 to each of the players playing those five gaming devices, the gaming system has provided the designated $1000.00 to players as progressive awards. Such a configuration provides camaraderie among players because the gaming system provides one or more players a currently displayed value of a progressive award as a result of another player's game outcome. In other words, players are not discouraged when another player triggers a progressive award because the gaming system provides the currently displayed value of that triggered progressive award to the player that triggered the progressive award and one or more additional players playing one or more gaming devices in the gaming system.

Additional features and advantages are described herein, and will be apparent from the following Detailed Description and the figures.

BRIEF DESCRIPTION OF THE FIGURES

FIG. 5 is a set of tables illustrating the probabilities associated with a plurality of progressive award hit values which correspond to one embodiment of the gaming system disclosed herein.

FIG. 6 is a table illustrating a calculation of the average expected progressive award hit value for table 1 of FIG. 5.

DETAILED DESCRIPTION

The present disclosure may be implemented in various configurations for gaming machines, gaming devices, or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
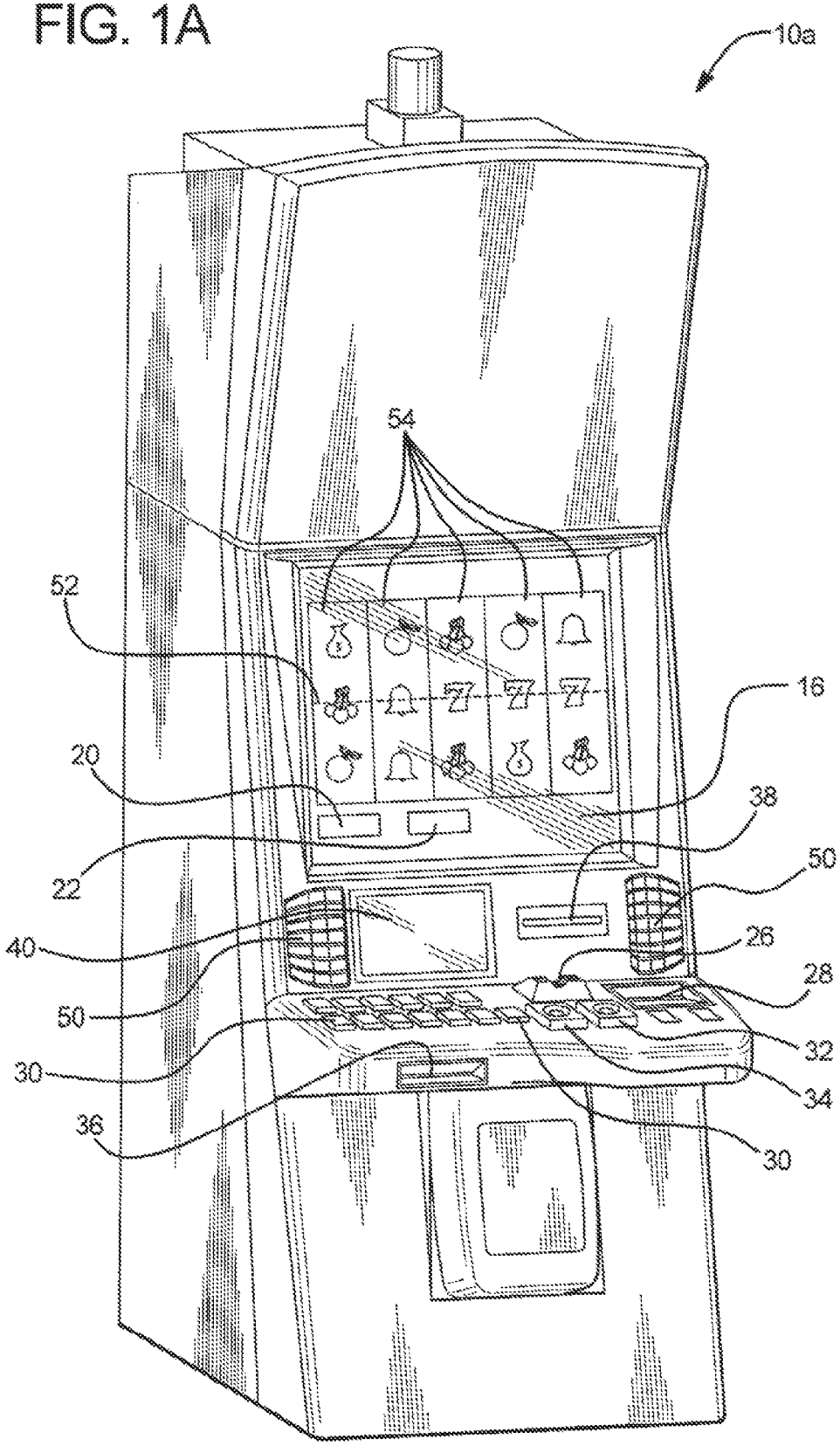
FIGS. 1A and 1B are front perspective views of alternative embodiments of gaming devices disclosed herein.
Figure 1B:
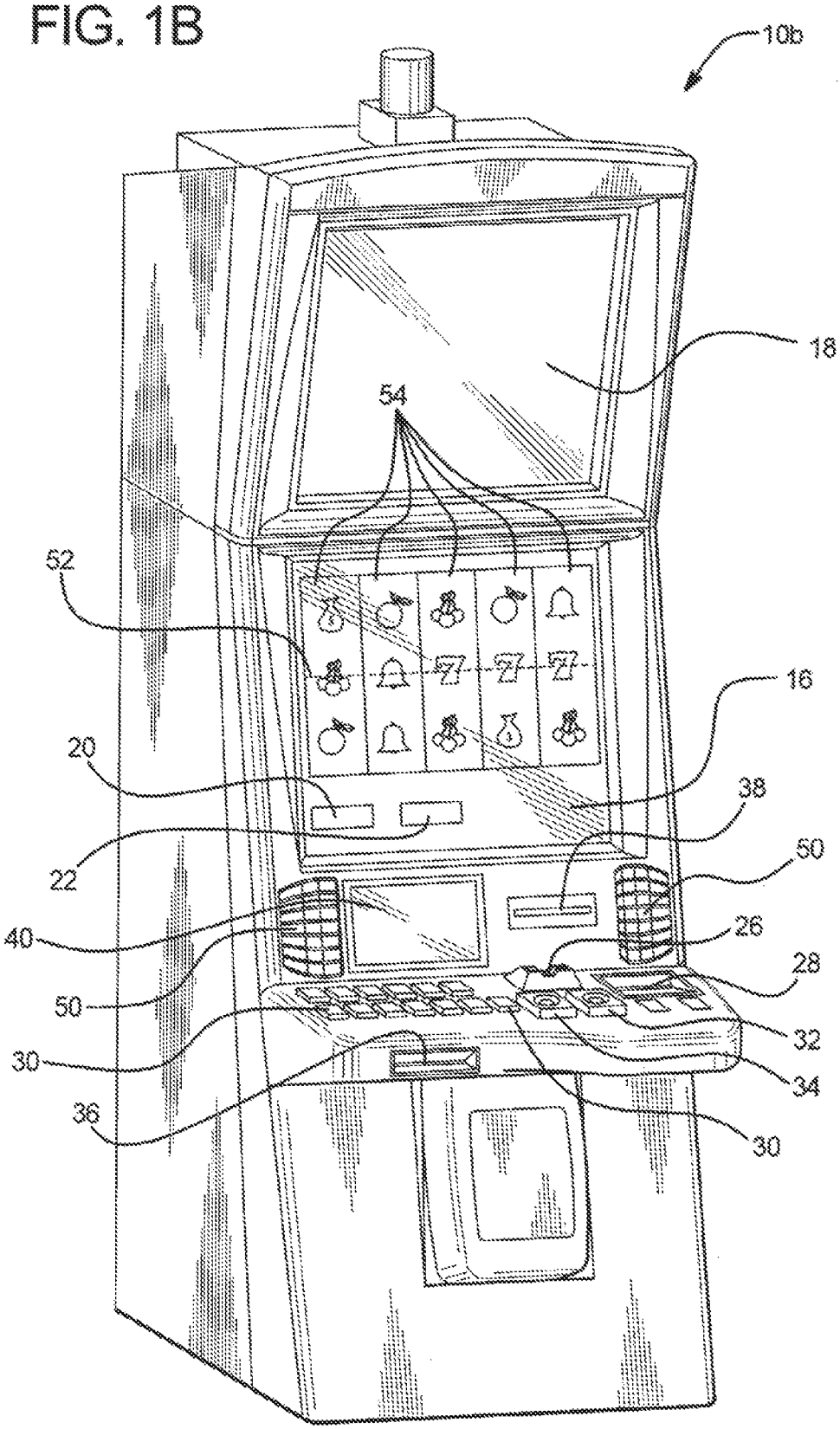

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet which provides support for a plurality of displays, inputs, controls, and other features of a conventional gaming machine. It is configured so that a player can operate it while standing or sitting. The gaming device can be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
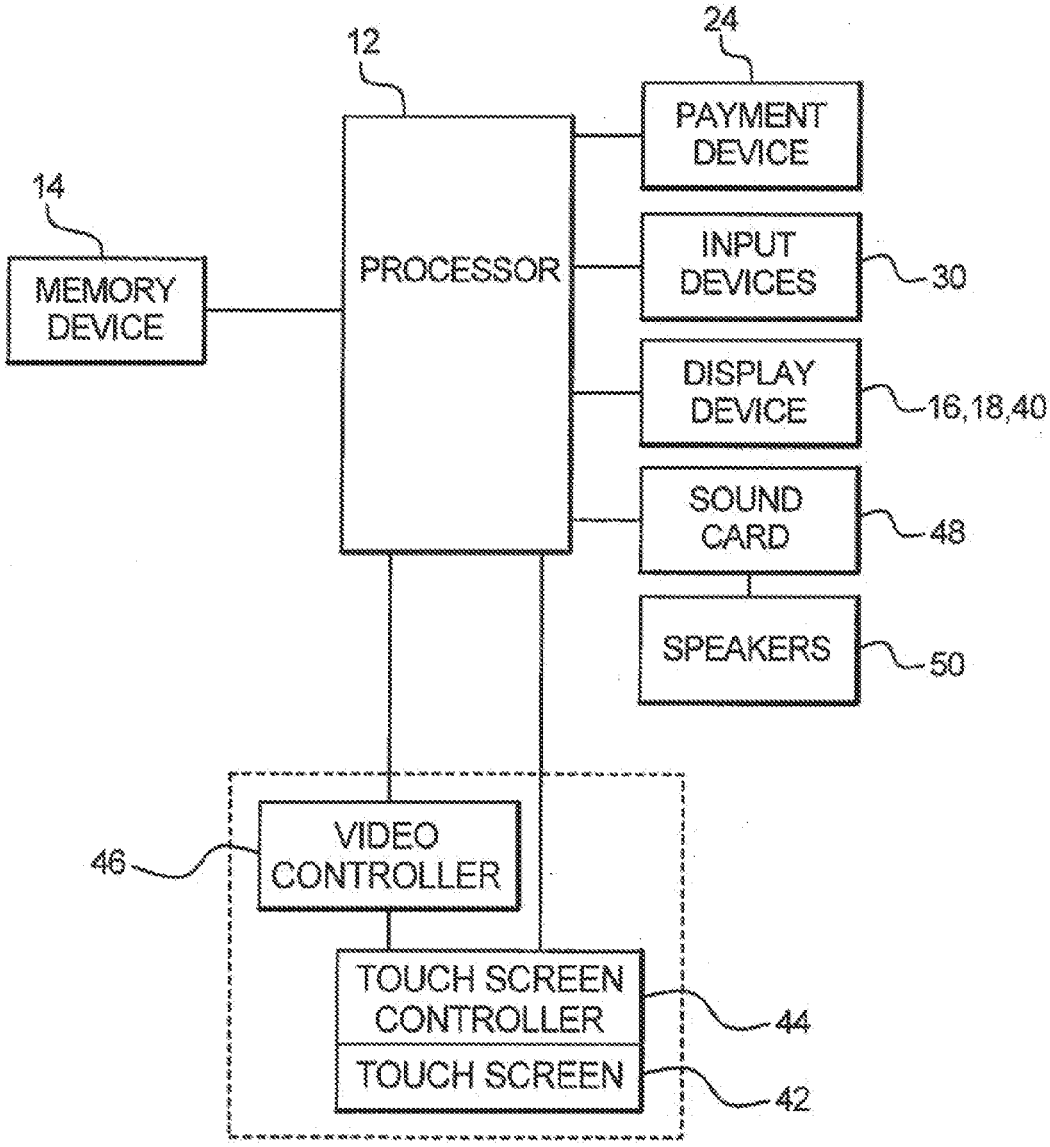
FIG. 2A is a schematic block diagram of the electronic configuration of one embodiment of a gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance, or the equivalent. In one embodiment, the gaming device includes a bet display 22 which displays a player's amount wagered. In one embodiment, as described in more detail below, the gaming device includes a player tracking display 40 which displays information regarding a player's play tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip, a coded magnetic strip or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as seen in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering game as the primary or base game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, displays the plurality of simulated video reels 54. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more than one or all of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the number of credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, a base or primary game may be a keno game wherein the gaming device displays a plurality of selectable indicia or numbers on at least one of the display devices. In this embodiment, the player selects at least one bit potentially a plurality of the selectable indicia or numbers via an input device such as a touch screen. The gaming device then displays a series of drawn numbers and determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or in a bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central controller 56 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
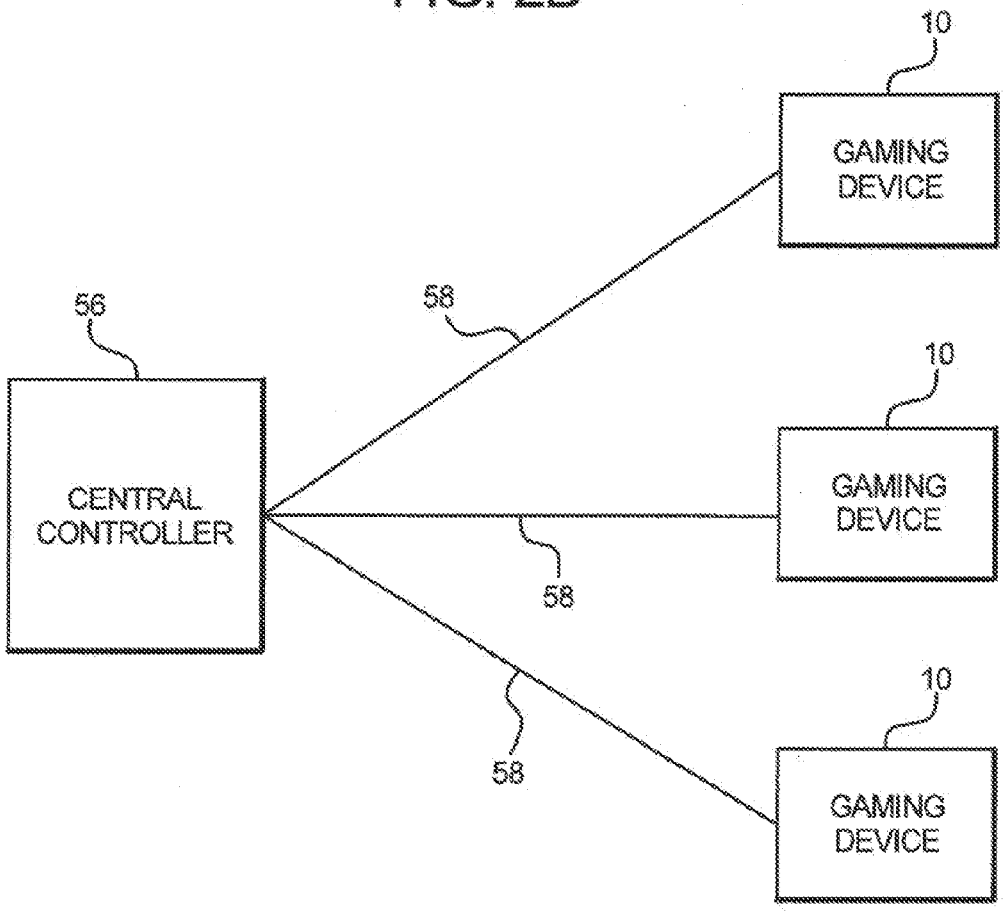
FIG. 2B is a schematic diagram of the central server in communication with a plurality of gaming devices in accordance with one embodiment of the gaming system disclosed herein.

In one embodiment, as illustrated in FIG. 2B, one or more of the gaming devices 10 are in communication with each other and/or at least one central controller 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller, central server or remote host as disclosed herein may be performed by one or more gaming device processors. It should be further appreciated that one, more or each of the functions of one or more gaming device processors as disclosed herein may be performed by the central controller, central server or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno or lottery game is not displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game, and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Multi-Hit Progressive Awards

Figure 3:
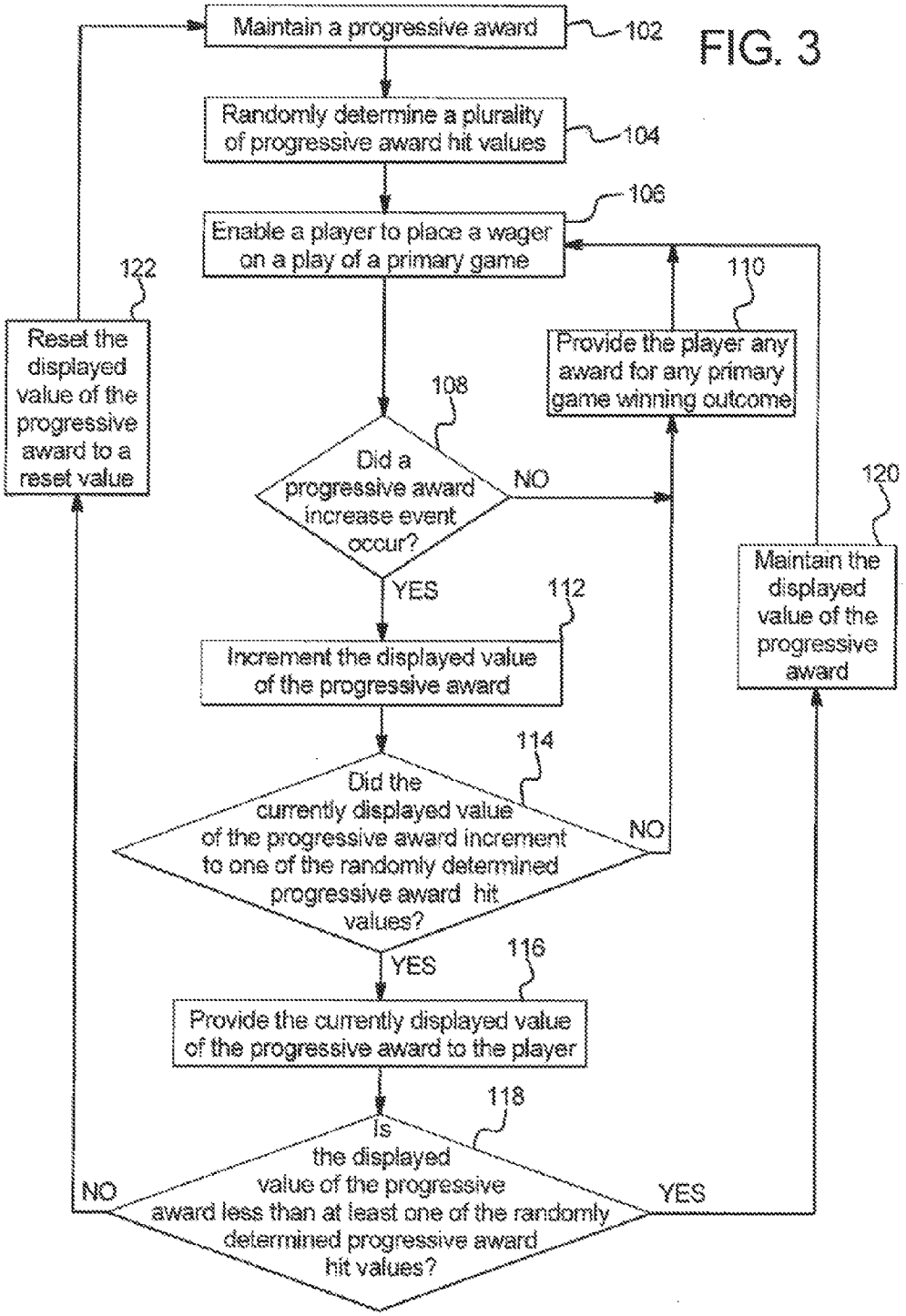
FIG. 3 is a flowchart of one embodiment of the gaming system disclosed herein and illustrating a primary game including a progressive award incrementing to a progressive award hit value, the current value of the progressive award being provided, wherein the current value of the progressive award is less than at least one of the randomly determined progressive award hit values, and the progressive award continuing to increment from the provided value.

Referring now to FIG. 3, a flowchart of an example process for operating a gaming system or a gaming device disclosed herein is illustrated. In one embodiment, this process is embodied in one or more software programs stored in one or more memories and executed by one or more processors or controllers. Although this process is described with reference to the flowchart illustrated in FIG. 3, it should be appreciated that many other methods of performing the acts associated with this process may be used. For example, the order of certain of the blocks described may be changed, or certain of the blocks described may be optional.

In operation of this embodiment, the gaming system maintains progressive award as indicated in block 102. In one embodiment, as discussed below, the maintained progressive award is associated with a plurality of different progressive award trigger values or progressive award hit values, such that a plurality of displayed incremented values of a progressive award are provided a plurality of times before the currently displayed value of that progressive award is reset to a reset value.

In one embodiment, the gaming system randomly determines a plurality of progressive award hit values as indicated in block 104. In one such embodiment, the gaming system associates each of these randomly determined progressive award hit values with a progressive award. The gaming system then enables the player to place a wager on a play of a primary game as indicated in block 106.

After receiving a wager from the player, the gaming system determines if a progressive award increase event has occurred as indicated in diamond 108. In one embodiment, if a progressive award increase event has not occurred, the gaming system provides the player any award for any primary game winning outcome as indicated in block 110. In one such embodiment, after the gaming system provides the player any award for any primary game winning outcome, the gaming system enables the player to place another wager on another play of the primary game as discussed above and as indicated in block 106.

In one embodiment, if a progressive award increase event occurs (e.g., a player places a wager on a play of a primary game), the gaming system increments the displayed value of the progressive award as indicated in block 112. In one such embodiment, the gaming system then determines if the currently displayed value of the progressive award has incremented to one of the randomly determined progressive award hit values as indicated in diamond 114. In another embodiment, the gaming system determines if the currently displayed value of the progressive award has incremented to within a suitable range of one of the randomly determined progressive award hit values.

In one embodiment, if the currently displayed value of the progressive award has not incremented to one of the randomly determined progressive award hit values (or has not incremented to within a suitable range of one of the randomly determined progressive award hit values), the gaming system provides the player any award for any primary game winning outcome as discussed above and as indicated in block 110. After providing the player any award for any primary game winning outcome, the gaming system enables a player to place another wager on another play of the primary game as discussed above and as indicated in block 106.

On the other hand, if the currently displayed value of the progressive award has incremented to one of the randomly determined progressive award hit values, the gaming system provides the currently displayed value of the progressive award to the player who is associated with the progressive award increase event which caused the currently displayed value of the progressive award to increment to that randomly determined progressive award hit value as indicated in block 116. In an alternative embodiment, if the displayed value of a progressive award has incremented to within a suitable range of a randomly determined progressive award hit value, the gaming system provides the then currently displayed value of the progressive award. In one embodiment, the gaming system then determines if the currently displayed value of the progressive award is less than at least one of the randomly determined progressive award hit values associated with the progressive award as indicated in diamond 118. It should be appreciated that although FIG. 3 illustrates the gaming system determining if the displayed value of the progressive award is less than at least one of the progressive award hit values associated with that progressive award when determining whether to reset the displayed value of the progressive award to a reset value, any suitable method of determining whether to reset the displayed value of the progressive award or to continue incrementing the displayed value of the progressive award may be implemented in accordance with the present disclosure.

In one embodiment, if the currently displayed value of the progressive award is less than at least one of the randomly determined progressive award hit values associated with the progressive award, the gaming system maintains the displayed value of the progressive award as indicated in block 120. That is, the gaming system continues incrementing the displayed value of the progressive award from the provided value upon the next suitable progressive award increase event. On the other hand, if the currently displayed value of the progressive award is not less than at least one of the randomly determined progressive award hit values associated with the progressive award, the gaming system resets the value of the progressive award to a reset value as indicated in block 122.

Figure 4:
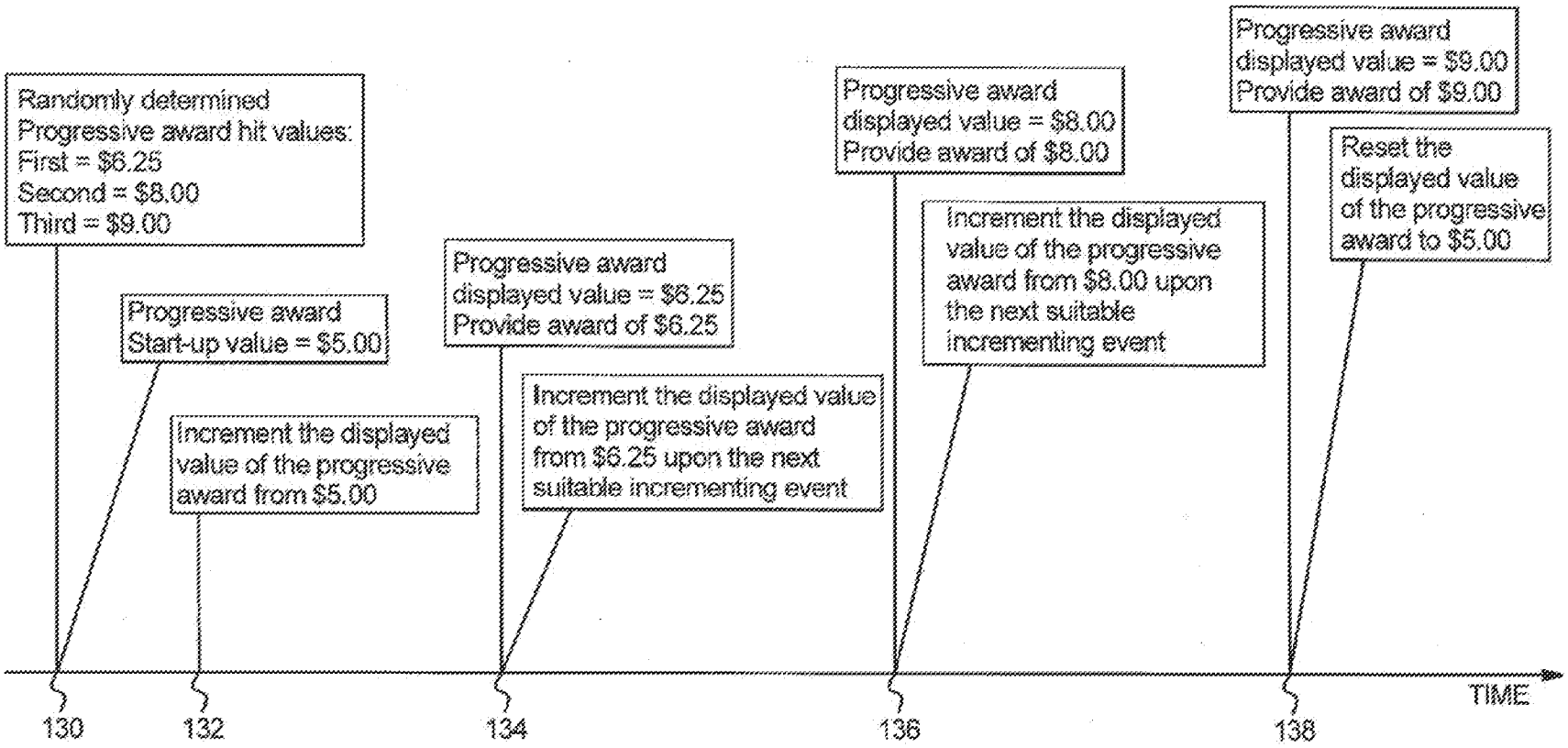
FIG. 4 is a timeline of the operation of one embodiment of the gaming system disclosed herein, illustrating a plurality of randomly determined progressive award hit values, a progressive award incrementing to each of the plurality of randomly determined progressive award hit values, and the progressive award resetting to a reset value.

In one embodiment, upon a suitable initializing event, the gaming system randomly determines a plurality of progressive award hit values to associate with a progressive award. For example, referring now to FIG. 4, at the point in time indicated by numeral 130, the gaming system randomly determines three progressive award hit values, wherein a first progressive award hit value is $6.25, a second progressive award hit value is $8.00, and a third progressive award hit value is $9.00. In an alternative embodiment, the gaming system associates a progressive award with one or more predetermined progressive award hit values.

After determining the progressive award hit values for the progressive award, the gaming system determines and displays a progressive award start-up value of $5.00. At the point in time indicated by numeral 132, a progressive award increase event occurs and the gaming system increments the displayed value of the progressive award from the displayed start-up value of $5.00. The gaming system subsequently continues incrementing the displayed value of the progressive award upon each suitable progressive award increase event which occurs on the gaming system. In one embodiment, as discussed above, if the displayed value of the progressive award increments to one of the randomly determined progressive award hit values, the gaming system provides the currently displayed value of the progressive award to the player who is associated with the progressive award increase event which caused the displayed value of the progressive award to increment to that progressive award hit value. For example, at the point in time indicated by numeral 134, a player places a wager on the gaming system which causes the currently displayed value of the progressive award to increment to $6.25. Accordingly, the gaming system provides $6.25 to that player. Since the currently displayed value of the progressive award is less than at least one of the progressive award hit values associated with the progressive award (i.e., $6.25<$8.00), the gaming system continues incrementing the displayed value of the progressive award from $6.25 upon a next suitable progressive award increase event which occurs on the gaming system. At the point in time indicated by numeral 136, the displayed value of the progressive award increments to $8.00 and the gaming system provides $8.00 to the player who is associated with the progressive award increase event which caused the displayed value of the progressive award to increment to $8.00. Since the currently displayed value of the progressive award is less than at least one of the progressive award hit values (i.e, $8.00<$9.00), the gaming system continues incrementing the displayed value of the progressive award from $8.00 upon a next suitable progressive award increase event which occurs on the gaming system. At the point in time indicated by numeral 138, the displayed value of the progressive award increments to $9.00. Accordingly, the gaming system provides $9.00 to the player that is associated with the progressive award increase event which caused the displayed value of the progressive award to increment to $9.00. Since the displayed value of the progressive award is not less than at least one of the progressive award hit values associated with the progressive award, the gaming system resets the displayed value of the progressive award to $5.00.

It should be appreciated that, as discussed above, in one embodiment a then currently displayed value of a progressive award is provided if the displayed value of the progressive award increments to within a suitable range of one of the progressive award hit values associated with the progressive award. In one such embodiment, the gaming system provides the player that is associated with the progressive award increase event a progressive award having a value that is equal to the designated progressive award hit value. In another such embodiment, the gaming system provides the player that is associated with the progressive award increase event a progressive award having a value that is equal to the currently displayed value of the progressive award as a result of the progressive award increase event.

While the embodiments discussed above are directed to a gaming system which maintains one progressive award, it should be appreciated that, in different embodiments, the gaming system described above is configured to maintain a plurality of progressive awards. That is, in different embodiments, the gaming system is configured to maintain a plurality of different progressive awards, wherein each maintained progressive award is associated with a plurality of progressive award hit values, such that the displayed value of each progressive award does not reset to a reset value until the displayed value of that progressive award has incremented to each of (or incremented to within a suitable range of each of) the plurality of progressive award hit values which are associated with that progressive award. Such a configuration provides that players can win a plurality of displayed incremented values of these progressive awards before the progressive awards are reset to a reset value. Such a configuration is further described in published U.S. Patent Application No. 2008/0090651.

In one embodiment, as discussed above, the gaming system randomly determines a plurality of progressive award hit values to associate with a progressive award. In one embodiment, the gaming system associates different quantities of progressive award hit values with different progressive awards. For example, the gaming system associates a first progressive award with three randomly determined progressive award hit values and a second progressive award with four randomly determined progressive award hit values. In this example, the gaming system provides three displayed incremented values of the first progressive award before the displayed value of the first progressive award is reset to a reset value and four displayed incremented values of the second progressive award before the displayed value of the second progressive award is reset to a reset value.

In different embodiments, the quantity of progressive award hit values that the gaming system associates with a progressive award is predetermined, randomly determined, or determined based on any other suitable method or criteria.

In different embodiments, each progressive award hit value the gaming system associates with a progressive award is determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria.

In one embodiment, the gaming system utilizes a plurality of tables or charts when randomly determining the plurality of progressive award hit values to associate with a progressive award. In this embodiment, each table or chart includes a plurality of different progressive award hit value ranges. For example, as seen in FIG. 5, each table includes ten different progressive award hit value ranges.

In one embodiment, the gaming system associates each progressive award hit value range in each table with a probability of being randomly selected by the gaming system. In one such embodiment, the gaming system associates each progressive award hit value range in each table with the same probability of being randomly selected by the gaming system. In another such embodiment, the gaming system associates a plurality of progressive award hit value ranges in each table with a different probability of being selected by the gaming system relative to other progressive award hit value ranges in that table. In other words, in this embodiment, each table includes one or more weighted progressive award hit values ranges. For example, as seen in FIG. 5, table 1 includes ten different ranges, wherein three of these ten different ranges are associated with higher probabilities of being selected by the gaming system relative to the other ranges in table 1.

In one embodiment, after the gaming system selects a progressive award hit value range, the gaming system selects a progressive award hit value from the selected progressive award hit value range. In different embodiments, the gaming system associates each progressive award hit value in each progressive award hit value range with a probability of being selected by the gaming system. In one embodiment, the gaming system associates a plurality of progressive award hit values in each range of progressive award hit values with a higher probability of being randomly selected by the gaming system relative to the other progressive award hit values in that range of progressive award hit values. In another embodiment, the gaming system associates the progressive award hit values in each range of progressive award hit values with the same probability of being selected by the gaming system. For example, in the table 1 of FIG. 5, for a progressive award hit value range of \$6.00 to \$6.49, wherein the progressive award hit values increment in \$0.01 intervals (e.g., \$6.00, \$6.01, . . . ,\$6.49), each of the fifty progressive award hit values in this range of progressive award hit values have the same probability of being selected by the gaming system.

In one embodiment, the gaming system utilizes one table in selecting a plurality of progressive award hit values. In another embodiment, the gaming system utilizes a plurality of tables in selecting a plurality of progressive award hit values. In one such embodiment, the quantity of tables the gaming system utilizes is the same as the quantity of progressive award hit values associated with the progressive award. For example, if the gaming system associates a progressive award with three different progressive award hit values, the gaming system utilizes three different tables when selecting the three progressive award hit values for the progressive award. In this example, the gaming system utilizes a different table for each progressive award hit value.

It should be appreciated that, in one embodiment, a configuration which includes selecting a plurality of progressive award hit values that are associated with weighted probabilities provides that the gaming system is likely to trigger a progressive award at designated points within the pay-range. For example, FIG. 6 illustrates the expected progressive award hit value calculation for table 1 of FIG. 5. In this example, the expected progressive award hit value selected by the gaming system for table 1 is \$6.87. Thus, it is likely that a progressive award hit value which is selected from table 1 will have a value of \$6.87. Accordingly, using the same methodology, the expected progressive award hit value selected by the gaming system for table 2 is \$7.82, and the expected progressive award hit value selected by the gaming system for table 3 is \$8.37.

In various alternative embodiments, the feature of providing a plurality of displayed values of a progressive award to one or more players before resetting the displayed value of that progressive award may be implemented in association with any of the progressive award triggering events disclosed herein. In one such alternative embodiment, the gaming system determines a quantity of progressive award triggering events which will occur in association with the progressive award (and which will each cause the currently displayed value of the progressive award to be provided) before resetting the displayed value of that progressive award to a reset value. For example, the gaming system determines to provide a displayed value of a progressive award at three different predetermined points in time before resetting the displayed value of the progressive award to a reset value. In this example, at the first predetermined point in time, a gaming device in the gaming system provides a first currently displayed value of a progressive award. After providing this first currently displayed value of the progressive award at this first predetermined point in time, the gaming system continues to increment the value of the progressive award from this first provided value (i.e., the gaming system does not reset the displayed value of the progressive award to a reset value). In this example, at a second predetermined point in time, a gaming device in the gaming system provides a second currently displayed value of the progressive award. After providing this second currently displayed value of the progressive award at this second predetermined point in time, the gaming system continues to increment the value of the progressive award from this second provided value (i.e., the gaming system does not reset the displayed value of the progressive award to a reset value). In this example, at a third predetermined point in time, a gaming device in the gaming system provides a third currently displayed value of a progressive award. After providing this third currently displayed value of the progressive award at this third predetermined point in time, the gaming system resets the displayed value of the progressive award because three displayed incremented value of the progressive award have been provided.

In another embodiment, the gaming system resets the displayed value of a progressive award after a plurality of designated symbol combinations associated with progressive award triggering events are generated and displayed (and the displayed values of the progressive award associated with each of these progressive award triggering events are provided). For example, the gaming system does not reset the displayed value of a progressive award until a designated symbol combination associated with a progressive award triggering event is displayed three times, wherein each time that designated symbol combination is displayed, the gaming system provides the then currently displayed value of the progressive award.

In another embodiment, the gaming system determines when to provide a progressive award based on an amount of coin-in since a previous progressive award triggering event. In one embodiment, when the amount of coin-in wagered on gaming devices in the gaming system reaches a designated threshold, the gaming system provides a currently displayed value of a progressive award to the player who placed the wager which caused the amount of coin-in wagered on the gaming system to reach that designated threshold.

In one embodiment, the gaming system increments the displayed value of a progressive award at a first increment rate until the amount of coin-in wagered on gaming devices in the gaming system since a previous progressive award triggering event (i.e., first amount of coin-in) reaches a first designated threshold. In one embodiment, when the amount of coin-in wagered on gaming devices in the gaming system reaches the first designated threshold, the gaming system provides a currently displayed value of the progressive award, wherein the displayed value of the provided progressive award is based, at least in part, on this first increment rate and this first amount of coin-in wagered on gaming devices in the gaming system. In one embodiment, if the gaming system has not provided a designated quantity of incremented values of the progressive award, the gaming system continues incrementing the displayed value of the progressive award from this provided value. In this embodiment, the gaming system increments the displayed value of the progressive award at a second, different increment rate until the amount of coin-in wagered on gaming devices in the gaming system since a previous progressive award triggering event reaches a second designated threshold. In one embodiment, when the amount of coin-in wagered on gaming devices in the gaming system since the previous progressive award triggering event reaches the second designated threshold, the gaming system provides a currently displayed value of the progressive award, wherein the displayed value of the provided progressive award is based, at least in part, on this second increment rate and this second amount of coin-in wagered on gaming devices in the gaming system. In one embodiment, the gaming system continues incrementing the displayed value of the progressive award at different increment rates after each progressive award triggering event until the gaming system provides the designated quantity of displayed incremented values of the progressive award.

Figure 7:
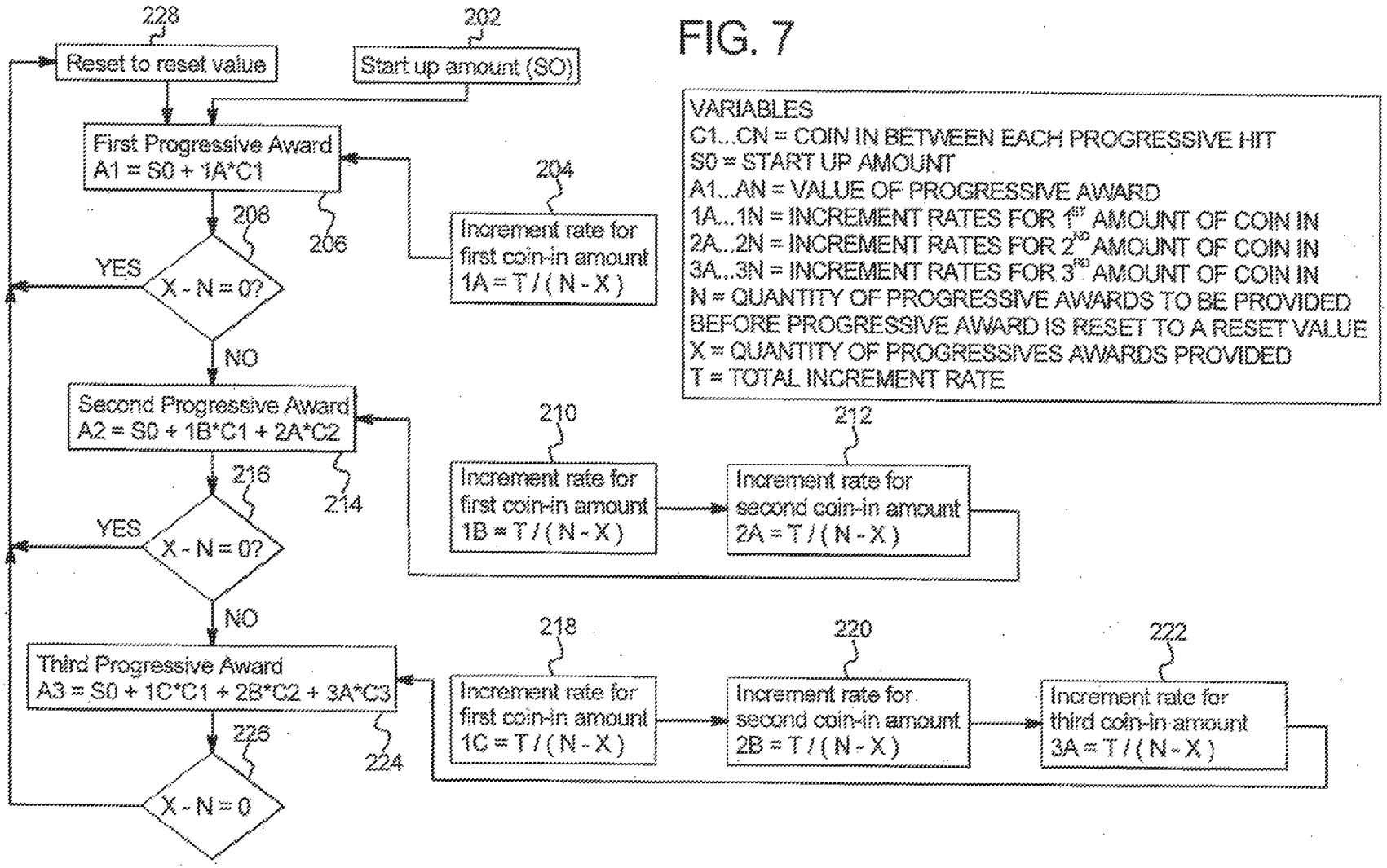
FIG. 7 is a flow chart of one embodiment of the gaming system disclosed herein and illustrating a primary game including a progressive award having a plurality of incremented values that are provided a plurality of times before the value of the progressive award is reset to a reset value.

Referring now to FIG. 7, a flowchart of an example process for operating a gaming system or a gaming device disclosed herein is illustrated. In one embodiment, this process is embodied in one or more software programs stored in one or more memories and executed by one or more processors or controllers. Although this process is described with reference to the flowchart illustrated in FIG. 7, it should be appreciated that many other methods of performing the acts associated with this process may be used. For example, the order of certain of the blocks described may be changed, or certain of the blocks described may be optional.

In operation of this embodiment, the gaming system determines an initially funded amount or a start-up amount (S0) as indicated in block 202. In one embodiment, the gaming system displays this initially funded amount as a current value of the progressive award. The gaming system also determines an increment rate for a first amount of coin-in (1A), wherein the increment rate for the first amount of coin-in is equal to the total increment rate (T) divided by the difference between the quantity of progressive awards to be provided before the displayed value of the progressive award is reset to a reset value (N) and the quantity of times a currently displayed value of the progressive award has been provided (X) as indicated in blocks 204, 210, and 218 (thus, 1A,1B,1C=T/(N−X)). In one embodiment, the gaming system increments the displayed value of the progressive award by this first increment rate until the amount of coin-in wagered on gaming devices in the gaming system reaches a first designated amount. When the amount of coin-in wagered on gaming devices in the gaming system reaches the first designated amount, the gaming system provides a then currently displayed value of the progressive award, wherein the then currently displayed value of the progressive award provided is equal to the sum of the start-up amount (S0) and the product of the multiplication of the increment rate for the first amount of coin-in (1A) by the amount of coin-in wagered on gaming devices in the gaming system before the first progressive award triggering event (C1) as indicated in block 206 (thus, A1=S0+1A*C1).

After the gaming system provides a currently displayed value of a progressive award, the gaming system determines if the difference between the quantity of times a currently displayed value of the progressive award has been provided (X) and the quantity of progressive awards to be provided before the displayed value of the progressive award is reset to a reset value (N) equals a value of zero as indicated in diamond 208 (thus, the gaming system makes a determination of whether X−N=0). If the difference between the quantity of times a currently displayed value of the progressive award has been provided (X) and the quantity of progressive awards to be provided before the displayed value of the progressive award is reset to a reset value (N) equals a value of zero, the gaming system resets the displayed value of the progressive award to a reset value as indicated in block 228. On the other hand, if the difference between the quantity of times a currently displayed value of the progressive award has been provided (X) and the quantity of progressive awards to be provided before the displayed value of the progressive award is reset to a reset value (N) is not equal to a value of zero, the gaming system does not reset the displayed value of the progressive award to a reset value. Rather, the gaming system continues incrementing the displayed value of the progressive award from this provided value.

The gaming system then determines an increment rate for a second amount of coin-in (2A), wherein the increment rate for the second amount of coin-in is equal to the total increment rate (T) divided by the difference between the quantity of progressive awards to be provided before the displayed value of the progressive award is reset to a reset value (N) and the quantity of times a currently displayed value of the progressive award has been provided (X) as indicated in blocks 212 and 220 (thus, 2A,2B=T/(N−X)). In one embodiment, the gaming system increments the displayed value of the progressive award by this second increment rate until the amount of coin-in wagered on gaming devices in the gaming system reaches a second designated amount. When the amount of coin-in wagered on gaming devices in the gaming system reaches the second designated amount, the gaming system provides a then currently displayed value of the progressive award, wherein the then currently displayed value of the provided progressive award is equal to the sum of the start-up amount (S0), the product of the multiplication of the increment rate for the first amount of coin-in (1B) by the amount of coin-in wagered on gaming devices in the gaming system before the first progressive award triggering event (C1), and the product of the multiplication of the increment rate for the second amount of coin-in (2A) by the amount of coin-in wagered on the gaming system since the first progressive award triggering event (C2) as indicated in block 214 (thus, A2=S0+1B*C1+2A*C2).

The gaming system then determines if the difference between the quantity of times a currently displayed value of the progressive award has been provided (X) and the quantity of progressive awards to be provided before the displayed value of the progressive award is reset to a reset value (N) equals a value of zero as discussed above and as indicated in diamond 216 (thus, the gaming system makes a determination of whether X−N=0). If the difference between the quantity of progressive awards provided (X) and the quantity of progressive awards to be provided before the displayed value of the progressive award is reset to a reset value (N) equals a value of zero, the gaming system resets the displayed value of the progressive award to the reset value as indicated in block 228. On the other hand, if the difference between the quantity of progressive awards provided (X) and the quantity of progressive awards to be provided before the displayed value of the progressive award is reset to a reset value (N) is not equal to a value of zero, the gaming system does not reset the displayed value of the progressive award to the reset value. Rather, the gaming system continues incrementing the displayed value of the progressive award from this provided value.

The gaming system then determines an increment rate for a third amount of coin-in (3A), wherein the increment rate for the third amount of coin-in is equal to the total increment rate (T) divided by the difference between the quantity of progressive awards to be provided before the displayed value of the progressive award is reset to a reset value (N) and the quantity of times a currently displayed value of the progressive award has been provided (X) as indicated in block 222 (thus, 3A=T/(N−X)). In one embodiment, the gaming system increments the displayed value of the progressive award by this third increment rate until the amount of coin-in wagered on gaming devices in the gaming system reaches a third designated amount. When the amount of coin-in wagered on gaming devices in the gaming system reaches the third designated amount, the gaming system provides a then currently displayed value of the progressive award, wherein the then currently displayed value of the progressive award provided is equal to the sum of the start-up amount (S0), the product of the multiplication of the increment rate for the first amount of coin-in (1C) by the amount of coin-in wagered on gaming devices in the gaming system before the first progressive award triggering event (C1), the product of the multiplication of the increment rate for the second amount of coin-in (2B) by the amount of coin-in wagered on gaming devices in the gaming system between the first progressive award triggering event and the second progressive award triggering event (C2), and the product of the multiplication of the increment rate for the third amount of coin-in (3A) by the amount of coin-in wagered on gaming devices in the gaming system since the second progressive award triggering event (C3) as indicated in block 224 (thus, A3=S0+1C*C1+2B*C2+3A*C3).

The gaming system then determines that the difference between the quantity of times a currently displayed value of the progressive award has been provided (X) and the quantity of progressive awards to be provided before the displayed value of the progressive award is reset to a reset value (N) equals a value of zero as indicated in diamond 226. The gaming system then resets the displayed value of the progressive award to a reset value as indicated in block 228. In other words, in this illustrated embodiment of FIG. 7, the quantity of progressive awards to be provided before the displayed value of the progressive award is reset to a reset value (N) is three. It should be appreciated that, in different embodiments, the gaming system is configured to provide a currently displayed value of a progressive award any number of times before the gaming system resets the value of that progressive award to a reset value (i.e., N can be any desired number).

For example, a gaming system maintains a progressive award which is configured to be provided three times (N=3) before the displayed value of the progressive award is reset to a reset value. In this example, the progressive award is associated with a total increment rate of 1.8% (T=1.8%), and an initial start-up value of $50.00 (S0=$50.00) which is initially displayed as a current value of the progressive award. The gaming system in this example requires $1000.00 of coin-in to be wagered on gaming devices in the gaming system between each progressive award triggering event (C1,C2, C3=$1000.00). In this example, the displayed value of the progressive award increments at a first rate equal to 0.6% (1A=1.6%/(3−0)) until a first progressive award triggering event occurs (e.g., $1000.00 has been wagered on gaming devices in the gaming system). When the first progressive award triggering event occurs, the gaming system provides a then displayed value of the progress award which is equal to $56.00 (i.e., $56.00=$50.00+0.6%*$1000.00). After the gaming system provides the $56.00 progressive award, the difference between the quantity of times a currently displayed value of the progressive award has been provided (X) and the quantity of progressive awards to be provided before the displayed value of the progressive award is reset to a reset value (N) is not equal to a value of zero (i.e., 3−1 does not equal 0), and thus the gaming system continues incrementing the displayed value of the progressive award from $56.00.

In this example, the displayed value of the progressive award then increments at a second rate of 0.9% (2A=1.8%/(3−1)) until a second progressive award triggering event occurs (e.g., another $1000.00 has been wagered on gaming devices in the gaming system). When the second triggering event occurs, the gaming system provides a then displayed value of the progressive award which is equal to $65.00 (i.e., $65.00=$50.00+0.6%*$1000.00+0.9%*$1000.00). After the gaming system provides the $65.00 progressive award, the difference between the quantity of times a currently displayed value of the progressive award has been provided (X) and the quantity of progressive awards to be provided before the displayed value of the progressive award is reset to a reset value (N) is not equal to a value of zero (3−2 does not equal 0), and thus the gaming system continues incrementing the displayed value of the progressive award from $65.00.

In this example, the displayed value of the progressive award then increments at a third rate of 1.8% (3A=1.8%/(3−2)) until a third progressive award triggering event occurs (e.g., another $1000.00 is wagered on gaming devices in the gaming system). When the third progressive award triggering event occurs, the gaming system provides a then displayed value of the progressive award which is equal to $83.00 (i.e., $83.00=$50.00+0.6')/0*$1000.00+0.9%*$1000.00+1.8%*$1000.00). After the gaming system provides the $83.00 progressive award, the difference between the quantity of times a currently displayed value of the progressive award has been provided (X) and the quantity of progressive awards to be provided before the displayed value of the progressive award is reset to a reset value (N) equals a value of zero (3−3 equals 0), and thus the gaming system resets the displayed value of the progressive award from $83.00 to $50.00. It should be appreciated that in this example, the displayed value of the progressive award increments at varying rates as progressive award triggering events occur. For example, prior to a first progressive award triggering event, the displayed value of the progressive award increments at a first rate, and after the first progressive award triggering event, the displayed value of the progressive award increments at a second, faster rate. In an alternative embodiment, the displayed value of the progressive award is configured to increment at a constant rate, regardless of the varying rate at which the value of the progressive award increments. For example, prior to a first progressive award triggering event, a displayed value of a progressive award increments at a first rate based on a first percentage of a first wager amount placed which funds the progressive award. In this example, after the occurrence of the first progressive award triggering event, the displayed value of the progressive award continues to increment at the first rate for the first wager amount placed, regardless of a change in the percentage of the first wager amount which funds the progressive award.

It should be appreciated that the total increment rate can be different for different progressive awards. It should also be appreciated that, in one embodiment, the amount of coin-in wagered on gaming devices in the gaming system before a subsequent progressive award triggering event occurs is different for subsequent progressive award triggering event.

In different embodiments, the amount of coin-in required before a progressive award triggering event occurs is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In an alternative embodiment, the gaming system maintains a progressive award wager pool and a reserve progressive award wager pool. In this embodiment, the gaming system allocates a first percentage of a first portion of each wager made at one or more gaming devices in the gaming system to the progressive award wager pool until the displayed value of the progressive award increments to (or increments to within a suitable range of) a first one of a plurality of progressive award hit values which are associated with that progressive award. In one embodiment, when the displayed value of the progressive award increments to (or increments to within a suitable range of) a first one of the progressive award hit values which is associated with that progressive award, the gaming system provides the currently displayed value of the progressive award, wherein the displayed value of the provided progressive award is funded via the progressive award wager pool. In one embodiment, as discussed above, if the displayed value of the progressive award is less than at least one of the progressive award hit values which are associated with that progressive award, the gaming system continues incrementing the displayed value of the progressive award from this first provided value. In this embodiment, the gaming system allocates a second, different percentage of each portion of each wager made at one or more gaming devices in the gaming system to the progressive award wager pool until the displayed value of the progressive award increments to (or increments to within a suitable range of) a second one of the progressive award hit values which is associated with that progressive award. In one embodiment, the difference between the first allocated percentage of the portion of each wager made at one or more gaming devices in the gaming system and this second allocated percentage of the portion of each wager made at one or more gaming devices in the gaming system is maintained in the reserve progressive award wager pool. In one embodiment, the gaming system continues incrementing the displayed value of the progressive award and allocating different percentages of the portion of each wager made at one or more gaming devices in the gaming system to the progressive award wager pool until the displayed value of the progressive award increments to (or increments to within a suitable range of) each one of the progressive award hit values which are associated with that progressive award. In one embodiment, when the displayed value of the progressive award increments to (or increments to within a suitable range of) a final one of the progressive award hit values which are associated with that progressive award, the gaming system resets the displayed value of the progressive award to a reset value, wherein the reset value is funded, at least in part, via the reserve progressive award wager pool.

For example, a gaming system allocates 0.9% of each wager placed on the gaming system to fund progressive awards. In this example, the gaming system initially allocates all 0.9% of each wager to the progressive award wager pool until the displayed value of the progressive award increments to a first one of a plurality of progressive award hit values associated with the progressive award. In other words, the gaming system allocates 0.9% of each wager placed on the gaming system to the progressive award wager pool and 0.0% of each wager placed on the gaming system to the reserve progressive award wager pool until the displayed value of the progressive award increments to the first one of the progressive award hit values which is associated with the progressive award. In this example, after the displayed value of the progressive award increments to the first one of the progressive award hit values and until the displayed value of the progressive award increments to a second one of the progressive award hit values, the gaming system allocates 0.6% of each wager placed on the gaming system to the progressive award wager pool and 0.3% of each wager placed on the gaming system to the reserve progressive award wager pool. Accordingly, after the displayed value of the progressive award increments to a second one of the progressive award hit values and before the displayed value of the progressive award increments to a third one of the progressive award hit values, the gaming system distributes 0.3% of each wager placed on the gaming system to the progressive award wager pool and 0.6% of each wager placed on the gaming system to the reserve progressive award wager pool. As discussed above, after the displayed value of the progressive award increments to a final one of the progressive award hit values, the gaming system resets the displayed value of the progressive award to a reset value, wherein the reset value is funded, at least in part, via the reserve progressive award wager pool. It should be appreciated that such a configuration provides a progressive award with a displayed value that initially increments at a relatively fast rate until incrementing to at least a first one of the progressive award hit values associated with the progressive award, after which the displayed value of the progressive increments at relatively slower increment rates until incrementing to a final progressive award hit value.

It should also be appreciated that, in one embodiment, after the displayed value of the progressive award is reset to a reset value, the gaming system also resets the percentage of each wager allocated to the progressive award wager pool and the reserve progressive award wager pool to a default value (e.g., reset to 0.9% of each wager placed allocated to the progressive award wager pool and 0.0% of each wager placed allocated to the reserve progressive award wager pool until the displayed value of the progressive award increments to a first one of the progressive award hit values associated with that progressive award).

In one embodiment, as discussed above, after the currently displayed value of the progressive award increments to a final one of the progressive award hit values, the gaming system resets the displayed value of the progressive award to a reset value. In one embodiment, after resetting the displayed value of the progressive award to a reset value, the gaming system increments the displayed value of the progressive award from the reset value at the first increment rate. In another embodiment, after resetting the displayed value of the progressive award to a reset value, the gaming system increments the displayed value of the progressive award from the reset value at a rate that is different than the first increment rate.

It should be appreciated that, in different embodiments, the rate at which the gaming system increments the displayed value of the progressive award is predetermined, randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria.

In one alternative embodiment, the gaming system does not reset the displayed value of a progressive award until a plurality of the same type of progressive award triggering events have occurred. For example, as described above, the gaming system does not reset the displayed value of a progressive award until the displayed value of the progressive award increments to a first progressive award hit value, a second progressive award hit value, and a third progressive award hit value. In another alternative embodiment, the gaming system does not reset the displayed value of a progressive award until at least two different types of progressive award triggering events occur. For example, the gaming system does not reset the displayed value of the progressive award until the displayed value of the progressive award increments to at least one progressive award hit value, and a designated symbol combination associated with a progressive award triggering event is displayed.

In one embodiment, the gaming system maintains a plurality of progressive awards, wherein each progressive award is associated with at least one progressive award hit value. In one such embodiment, at least one of the maintained progressive awards is initially active (i.e., can be provided to one or more players) and at least one of the progressive awards is initially inactive (i.e., cannot be provided to one or more players). If the displayed value of an active progressive award increments to any of the progressive award hit values associated with that active progressive award, the displayed value of that active progressive award is provided. In one embodiment, if the displayed value of the active progressive award increments to each of the progressive award hit values associated with that active progressive award, the gaming system deactivates that progressive award and, if at least one of the plurality of inactive progressive awards has not yet been activated, the gaming system activates that inactive progressive award, wherein the displayed value of the activated progressive award begins incrementing from the last provided value of the deactivated progressive award.

In another embodiment, the gaming system maintains a progressive award wager pool that is associated with a plurality of progressive award sub-wager pools. In this embodiment, the gaming system allocates a portion of each wager placed on the gaming system to the progressive award wager pool, such that the progressive award wager pool maintains a value. The gaming system then allocates a percentage of the value of the progressive award wager pool to each of the plurality of progressive award sub-wager pools. In one embodiment, the gaming system allocates the same percentage of the value of the progressive award wager pool to each of the plurality of progressive award sub-wager pools. In another embodiment, the gaming system allocates a different percentage of the value of the progressive award wager pool to each of the plurality of progressive award sub-wager pools. Accordingly, as discussed above, each time the displayed value of the progressive award increments to one of a plurality of progressive award hit values which are associated with the progressive award, the gaming system provides the currently displayed value of the progressive award to the player who is associated with the progressive award increase event which caused the displayed value of the progressive award to increment to that progressive award hit value, wherein the provided value of the progressive award is funded via one of the progressive award sub-wager pools.

In another embodiment, rather than or in addition to providing a player or a plurality of players a plurality of displayed incremented values of a progressive award a plurality of times, if a progressive award triggering event occurs, the gaming system simultaneously provides a displayed incremented value of a progressive award to each of a plurality of players. That is, in this embodiment, if a progressive award triggering event occurs, in addition to providing a currently displayed value of a progressive award to a player who is associated with the progressive award triggering event, the gaming system also provides the currently displayed value of that progressive award to one or more additional players at one or more gaming devices in the gaming system. In one embodiment, the gaming system tracks monetary amounts that are designated to be provided as progressive awards. In this embodiment, the gaming system determines a portion of the tracked amounts, wherein the determined portion is based on the quantity of gaming devices that can each potentially provide a currently displayed value of the progressive award to a player playing that gaming device. In another embodiment, the gaming system determines a portion of the tracked amounts, wherein the determined portion is based on a quantity of players that are each eligible to win a currently displayed value of a progressive award. In these embodiments, after determining a portion of the tracked monetary amounts designated to be provided as progressive awards, the gaming system then displays, to each player playing a gaming device in the gaming system, the determined portion as a current value of the progressive award. In one embodiment, if a progressive award triggering event occurs, the gaming system determines a quantity of gaming devices to each provide a currently displayed value of the triggered progressive award. In one embodiment, the gaming system then provides the currently displayed value of the progressive award to the players playing each of the determined quantity of gaming devices in the gaming system. It should be appreciated that, in this embodiment, the value that the gaming system displays as the value of a progressive award is a fraction of the actual value that the gaming system designates to be provided as progressive awards. It should also be appreciated that, in different embodiments, a lag or delay occurs between a player placing a wager and a value of a displayed progressive award incrementing as a result of the placed wager.

For example, if ten gaming devices in a gaming system could each potentially provide a currently displayed value of a progressive award, for each of these ten gaming devices to provide a progressive award having a same value in the event that a progressive award triggering event occurs, the gaming system allocates 10% of the amount designated to be provided as progressive awards to the displayed value of the progressive award. For example, if a first amount of $50,000.00 has been allocated to be provided via one or more progressive awards, then based on the ten gaming devices that could each potentially provide a same valued progressive award, the gaming system displays a second amount of $5,000.00 (i.e., $50,000.00/10=$5,000.00) as the current value of the progressive award. In this example, a progressive award triggering event occurs and six of these ten gaming devices provide the current value of the progressive award. Accordingly, in this example, as discussed in more detail below, because only $30,000.00 (i.e., $5,000×6=$30,000.00) of the allocated $50,000.00 is provided as progressive awards, the gaming system maintains $20,000.00 of the allocated $50,000.00 as a remainder. It should be appreciated that providing a currently displayed value of a progressive award to each of a plurality of players playing gaming devices in a gaming system creates an atmosphere of camaraderie among players. In such embodiments, players are not discouraged when another player triggers a progressive award because the gaming system provides the currently displayed value of that triggered progressive award to the player that triggered the progressive award and one or more additional players playing one or more gaming devices in the gaming system.

In one embodiment, the determination of which gaming devices provide the currently displayed value of the progressive award is based on a determined status of the players playing those gaming devices. In one such embodiment, if a player playing a gaming device in the gaming system triggers a progressive award, the gaming system provides the currently displayed value of the triggered progressive award to the player playing that gaming device and to any other players actively playing gaming devices which are determined to be in active status in the gaming system. For example, a gaming system is associated with five gaming devices and displays a value of a progressive award. In this example, if the currently displayed value of the progressive award is $200.00, and a player playing a gaming device in the gaming system triggers the progressive award, the gaming system provides $200.00 to that player and to any other players that are playing gaming devices in the gaming system which are determined to be in active status. It should be appreciated that, in this example, while the gaming system displays a current value of $200.00 for a progressive award, because five gaming devices could each potentially provide a progressive award, the gaming system has actually accrued $1000.00 to be provided as progressive awards.

In one embodiment, if a progressive award triggering event occurs, each gaming device in the gaming system is determined to be in either active status or enrolled or inactive status, wherein each gaming device in the gaming system in active status provides a currently displayed value of a progressive award. In this embodiment, active status means that the gaming device is being actively played by a player, wherein the active status requirements can be based on any suitable number of satisfied criteria or defined in any suitable manner by the implementer of the gaming system. For example, the current level of a gaming device's accumulated wager pool (i.e., is an accumulated wager pool at or above a designated threshold wager level) may be part of the determination of whether that gaming device is in the active status. In another example, a play of or wager on the primary game of the gaming device within a predetermined period of time may be part of the determination of whether that gaming device is in the active status. Other factors such as: (a) the amount of time between each play of or wager on the primary game of the gaming device; (b) the amount being wagered on the primary game(s); and (c) the number of plays within a period of time, may also or alternatively be part of the determination of whether a gaming device is in the active status. On the other hand, inactive status means that the gaming device is not in the active status (i.e., not being actively played by a player according to one or more of the predetermined criteria).

In another embodiment, the determination of which players are each provided the currently displayed value of the progressive award is based on the quantity of players playing gaming devices in the gaming system. In this embodiment, if a player playing a gaming device in the gaming system triggers a progressive award, the gaming system provides the currently displayed value of the triggered progressive award to that player and to any other players playing gaming devices in the gaming system.

In another embodiment, the determination of which players are each provided the current value of the progressive award is based on which gaming devices cause a progressive award triggering event. In this embodiment, if a plurality of players playing gaming devices in the gaming system simultaneously trigger the same progressive award, the gaming system provides each of those players the currently displayed value of that triggered progressive award. In another embodiment, if a player playing a gaming device in the gaming system triggers a progressive award, any additional players playing gaming devices in the gaming system that also trigger the progressive award within a designated period of time are also provided the currently displayed value of the triggered progressive award.

Figure 8:
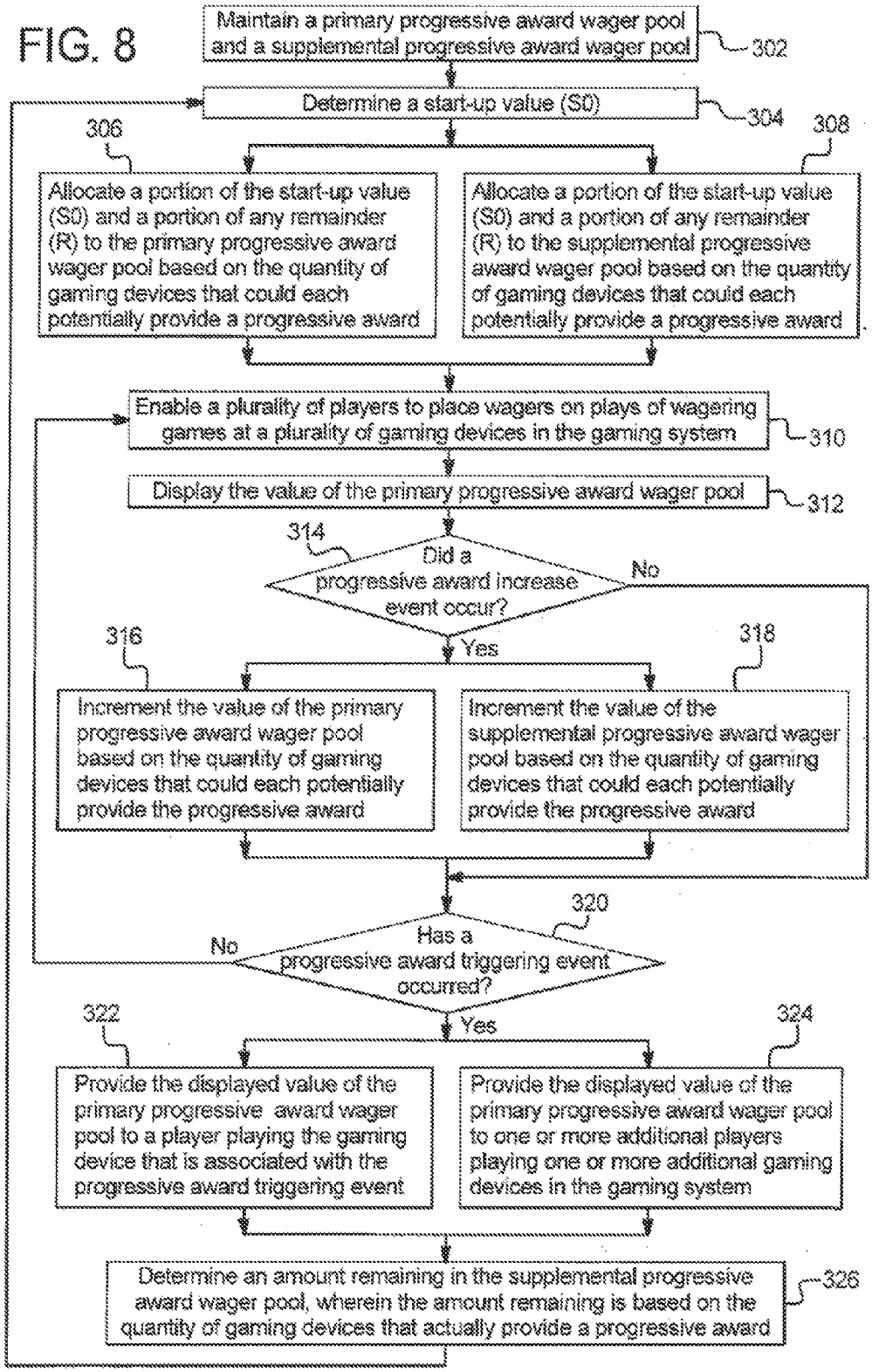
FIG. 8 is a flowchart of one embodiment of the gaming system disclosed herein and illustrating a primary game including a primary and a supplemental progressive award wager pool, incrementing both the primary and the supplemental progressive award wager pools, providing a current value of the primary progressive award wager pool to a player that is associated with a progressive award triggering event, providing the same current value of the primary progressive award wager pool to one or more additional players, and determining any amount remaining in the supplemental progressive award wager pool.

Referring now to FIG. 8, a flowchart of an example process for operating a gaming system or a gaming device disclosed herein is illustrated. In one embodiment, this process is embodied in one or more software programs stored in one or more memories and executed by one or more processors or controllers. Although this process is described with reference to the flowchart illustrated in FIG. 8, it should be appreciated that many other methods of performing the acts associated with this process may be used. For example, the order of certain of the blocks described may be changed, or certain of the blocks described may be optional.

In operation of this embodiment, the gaming system maintains a primary progressive award wager pool and a supplemental progressive award wager pool as indicated in block 302. In one embodiment, the gaming system determines a start-up value (S0) as indicated in block 304. The gaming system then allocates a portion of the start-up value (S0) and a portion of any remainder (R) to the primary progressive award wager pool based on the quantity of gaming devices that could each potentially provide a progressive award as indicated in block 306. The gaming system also allocates a portion of the start-up value (S0) and a portion of any remainder (R) to the supplemental progressive award wager pool based on the quantity of gaming devices that could each potentially provide a progressive award as indicated in block 308.

In one embodiment, the amount of the start-up value (S0) that the gaming system allocates to the primary progressive award wager pool (PP) is equal to the quotient of the start-up value of the progressive award (S0) divided by the quantity of gaming devices that could each potentially provide a progressive award (Q) (thus, PP=S0/Q). In this embodiment, the amount that the gaming system allocates to the supplemental progressive award wager pool (SP) is described by the equation SP=S0*(1−1/Q), wherein (S0) represents the progressive award start-up value and (Q) represents the quantity of gaming devices that could each potentially provide a progressive award. That is, in this embodiment, the portion of the start-up value that the gaming system allocates to the supplemental progressive award wager pool (SP) is equal to the product of the multiplication of the start-up value of the progressive award (S0) by the quantity of 1 less the quotient of 1 divided by the quantity of gaming devices that could each potentially provide a progressive award (Q).

In one embodiment, the gaming system allocates a portion of any amount that remains a supplemental progressive award wager pool from a previous progressive award triggering event to the primary and the supplemental progressive award wager pools. In another embodiment, the gaming system only allocates a portion of the total increment that remains in the supplemental progressive award wager pool from a previous progressive award triggering event (R) to the primary and the supplemental progressive award wager pools. In one such embodiment, the amount of the total increment that remains in the supplemental progressive award wager pool from a previous progressive award triggering event (R) that the gaming system allocates to the primary progressive award wager pool is equal to the quotient of the amount of the total increment remaining in the supplemental progressive award wager pool from a previous progressive award triggering event (R) divided by the quantity of gaming devices that could each potentially provide a progressive award (Q) (thus, R/Q). In this embodiment, the portion of the amount of the total increment remaining in the supplemental progressive award wager pool from a previous progressive award triggering event (R) that the gaming system allocates to the supplemental progressive award wager pool is described by the equation AS=R*(1−1/Q), wherein (R) describes the amount of the total increment remaining in the supplemental progressive award wager pool from a previous progressive award triggering event and (Q) describes the quantity of gaming devices that could each potentially provide a progressive award.

After allocating portions of the start-up value and any remainder to the primary and the supplemental progressive award wager pools, the gaming system enables a plurality of players to place wagers on plays of games at a plurality of gaming devices in the gaming system as indicated in block 310. In one embodiment, the gaming system displays the value of the primary progressive award wager pool as indicated in block 312. That is, in this embodiment, the displayed value of the progressive award is merely a fraction of the actual value being accrued to be provided as progressive awards.

The gaming system then determines if a progressive award increase event occurs as indicated in diamond 314. In one embodiment, the gaming system allocates a portion of each suitable wager placed on each of the gaming devices in the gaming system to incrementing the value of the progressive award.

In one embodiment, if a progressive award increase event occurs, the gaming system increments the displayed value of the primary progressive award wager pool based on the quantity of gaming devices that could each potentially provide a progressive award as indicated in block 316. The gaming system also increments the value of the supplemental progressive award wager pool based on the quantity of gaming devices that could each potentially provide a progressive award as indicated in block 318.

In one embodiment, the amount the gaming system increments the displayed value of the primary progressive award wager pool (IPP) is equal to the quotient of the allocated portion of the placed wager (W) divided by the quantity of gaming devices that could each potentially provide a progressive award (Q) (thus, IPP=W/Q). In this embodiment, the amount the gaming system increments the value of the supplemental progressive award wager pool (ISP) is described by the equation ISP=W*(1−1/Q), wherein (W) represents the allocated portion of the placed wager and (Q) represents the quantity of gaming devices that could each potentially provide a progressive award.

In one embodiment, if a progressive award increase event does not occur, or after the gaming system increments the displayed value of the primary progressive award wager pool and the value of the supplemental progressive award wager pool, the gaming system determines if a progressive award triggering event occurs as indicated by block 320.

In one embodiment, a progressive award triggering event occurs based on a displayed event in a play of one or more displayed games of one or more of the gaming devices in the gaming system. In another embodiment, a progressive award triggering event occurs independent of any displayed event in any play of any game of any of the gaming devices in the gaming system. In another embodiment, the gaming system tracks the occurrences of one or more suitable events occurring at or in association with one or more players and/or one or more gaming devices in the gaming system and determines, based on these tracked events, whether a progressive award triggering event has occurred. In another embodiment, the gaming system defines one or more game play parameters, wherein each time a player's tracked game play activity satisfies the defined parameter, the progressive award triggering event occurs.

In one embodiment, if a progressive award triggering event does not occur, the gaming system enables a plurality of players to place wagers on plays of games at a plurality of gaming devices in the gaming system as indicated in block 310. In one embodiment, if a progressive award triggering event occurs, the gaming system provides the displayed value of the primary progressive award wager pool to a player playing a gaming device that is associated with the progressive award triggering event as indicated in block 322. In this embodiment, the gaming system also provides the displayed value of the primary progressive award wager pool to one or more additional players playing one or more additional gaming devices in the gaming system as indicated in block 324. That is, in this embodiment, in addition to providing the currently displayed value of the primary progressive award wager pool to the player playing a gaming device that is associated with the progressive award triggering event, the gaming system also provides the currently displayed value of the primary progressive award wager pool to one or more additional players playing one or more additional gaming devices in the gaming system.

In one embodiment, the value of the progressive award provided to the player associated with the progressive award triggering event is funded via the primary progressive award wager pool. In this embodiment, any progressive awards provided to any additional players playing gaming devices in the gaming system are funded via the supplemental progressive award wager pool.

In one embodiment, the displayed value of the primary progressive award wager pool (PPA) is described by the equation $PPA=1/Q*(S0+Z+FR)$, wherein (S0) represents the progressive award start-up value, (Z) represents the total increment amount, (R) represents the amount of the total increment remaining in a supplemental progressive award wager pool from a previous progressive award triggering event, and (Q) represents the quantity of gaming devices that could each potentially provide a progressive award. It should be appreciated that, in this embodiment, the total increment amount (Z) is based on the allocated portion of placed wagers which occur on gaming devices in the gaming system prior to the progressive award triggering event.

In one embodiment, after providing a currently displayed value of the progressive award to the player associated with the progressive award triggering event and to any additional players playing gaming devices in the gaming system, as discussed above, the gaming system determines the amount of the total increment remaining in the supplemental progressive award wager pool (R) as indicated in block 326.

In one embodiment, the amount remaining in the supplemental progressive award wager pool is described by the equation $R=Z-[Z*(1/Q)]-[(1/Q)*Z*(Y-1)]$, wherein (Z) represents the total amount increment amount, (Q) represents the quantity of gaming devices that could each potentially provide a progressive award, and (Y) represents the quantity of gaming devices that actually provide a progressive award. It should be appreciated that, the supplemental progressive award wager pool has an amount remaining if the quantity of gaming devices that actually provide a progressive award (Y) is less than the quantity of gaming devices that could each potentially provide a progressive award (Q) (i.e., $Y<Q$).

For example, a gaming system is associated with ten gaming devices (i.e., the quantity of gaming devices that could each potentially provide a progressive award (Q) is ten). In this example, if a progressive award triggering event occurs and the six of those ten gaming devices cause a currently displayed value of the progressive award to be provided (i.e., the quantity of gaming devices that actually provide a progressive award (Y) is six), the supplemental progressive award wager pool has a remainder (R) because the quantity of gaming devices that actually provide a progressive award is less than the quantity of gaming devices that could each potentially provide a progressive award (i.e., $6<10$).

It should be appreciated that, if the quantity of gaming devices that actually provide a progressive award is equal to the quantity of gaming devices that could each potentially provide a progressive award, the amount of the total increment remaining in the supplemental progressive award wager pool (R) is equal to a value of zero.

In another alternative embodiment, the gaming system includes a plurality of gaming devices linked by a common gaming element wherein, during a community game triggering event, the common gaming element generates a separate or individual outcome for each linked or associated gaming device in the gaming system and wherein a plurality of the generated outcomes are associated with a progressive award. In one embodiment, the separate outcomes are simultaneously generated or displayed to each player of each gaming device associated with the community game triggering event. In one embodiment, upon community game triggering event, one or more players playing one or more gaming devices in the gaming system take part in the triggered community game event to achieve an individual or separate outcome, such as winning a currently displayed value of a progressive award.

Figure 9:
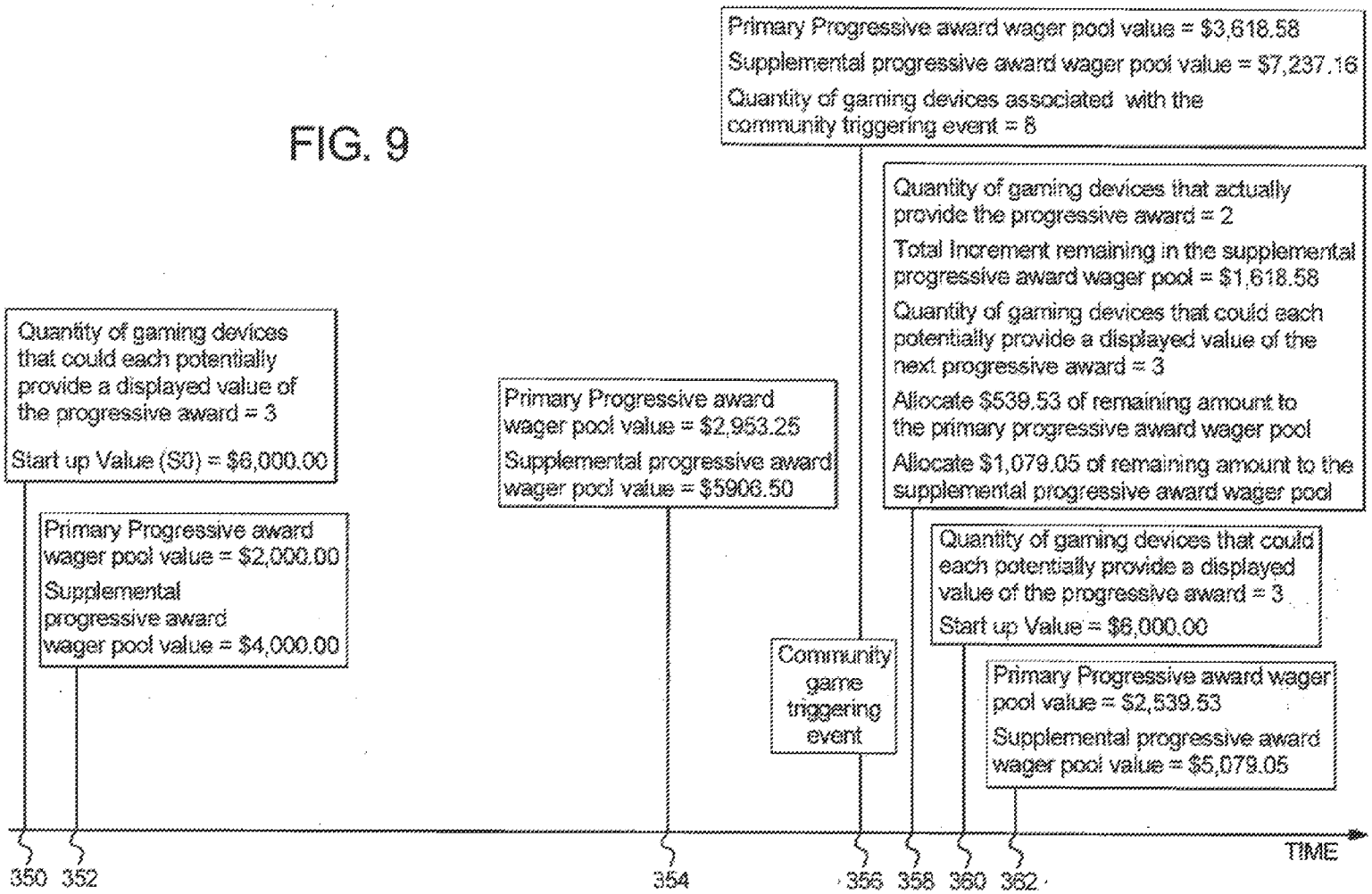
FIG. 9 is a timeline of the operation of one embodiment of the gaming system disclosed herein illustrating a progressive award incrementing until an occurrence of a community game triggering event, providing a current value of a supplemental progressive award wager pool to a plurality of players, and determining an amount remaining in a supplemental progressive award wager pool.

In one embodiment, as discussed above, upon a suitable initializing event, the gaming system determines a start-up value to be allocated to a primary and a supplemental progressive award wager pool. For example, referring now to FIG. 9, at the point in time indicated by numeral 350, the gaming system determines a start-up value of $6,000.00 to be allocated to a primary and a supplemental progressive award wager pool, wherein, for a play of a triggered community game, the gaming system can cause a currently displayed value of a progressive award to be provided three times. It should be appreciated that, in this example, the amount of the total increment remaining in the supplement progressive award wager pool from a previous progressive award triggering event is zero. At the point in time indicated by numeral 352, the gaming system allocates $2,000.00 of the $6,000.00 start-up value to the primary progressive award wager pool, and allocates $4,000.00 of the $6,000.00 start-up value to the supplemental progressive award wager pool. The gaming system then displays the current value of the primary progressive award wager pool.

As discussed above, the gaming system then enables players to place wagers on plays of games at a plurality of gaming devices in the gaming system, and upon each suitable progressive award increase event, the gaming system increments the value of the primary and the supplemental progressive award wager pools based on the quantity of gaming devices that could each potentially provide a current value of the progressive award, and displays the incremented value of the primary progressive award wager pool. For example, at the point in time indicated by numeral 354, as a result of a plurality of progressive award increase events occurring on the gaming system, the displayed incremented value of the primary progressive award is $2,953.25, and the incremented value of the supplemental progressive award wager pool is $5,906.50.

In one embodiment, if a community game triggering event occurs, one or more players playing one or more gaming devices in the gaming system take part in a community game to achieve an individual or separate outcome, such as winning the currently displayed value of the primary progressive award wager pool. For example, referring now to FIG. 10, in operation of one embodiment, the gaming system includes a plurality of gaming devices 10*a* to 10*l*, which are each associated with shared display element 110, as further described in U.S. Pat. No. 7,311,604. In this example, shared display element 110 is a circular wheel having awards 62 displayed within each respective section, panel or demarcation 64 which are fixed spatially with respect to each of the other awards 62 within their respective sections 64 of the shared display. For example, Progressive #1 currently indicated by gaming device 10*e* is positioned to the right of value eighty and to the left of value forty. In this example, shared display element 110 is operable to generate different outcomes for different plays of the triggered community game.

Referring back to FIG. 9, at the point in time indicated by numeral 356, a community game triggering event occurs, wherein the displayed incremented value of the primary progressive award wager pool is $3,618.58 and the incremented value of the supplemental progressive award wager pool is $7,237.16, and players playing at a plurality of gaming devices take part in the triggered community game.

For example, referring back now to FIG. 10, if players playing gaming devices 10*a*, 10*b*, 10*c*, 10*e*, 10*g*, 10*h*, 10*k* and 10*l* each take part in the triggered community game, and the outcome illustrated represents the outcome of a spin of shared display element 110 in the triggered community game, the player playing gaming device 10*a* receives an award of $15.00, the players playing gaming devices 10*b* and 10*e* each receive the currently displayed value of the progressive award (i.e., Progressive #1) of which is $3,618.58, the player playing gaming device 10*c* receives an award of $75.00, the player playing gaming device 10*g* receives an award of $1,000.00, the player playing gaming device 10*h* receives an award of $100.00, the player playing gaming device 10*k* receives an award of $5.00, and the player playing gaming device 10*l* receives an award of $90.00.

Referring back now to FIG. 9, after the gaming system provides the appropriate awards to each of the players that take part in the triggered community game, the gaming system determines the amount of the total increment remaining in the supplemental progressive award wager pool (R). For example, at the point in time indicated by numeral 358, the gaming system determines that, because the gaming system only provides the currently displayed value of the primary progressive award wager pool to two players, $3,618.58 remains in the supplemental progressive award wager pool. That is, $2000.00 of the original start-up amount and $1,618.58 of the total increment remains in the supplemental progressive award wager pool (i.e., Current Value−Start-up value=Total Increment). In one embodiment, the gaming system allocates the total amount remaining in the supplemental progressive award wager pool to the primary and supplemental progressive award wager pools. In another embodiment, the gaming system allocates only a portion of the total amount remaining in the supplemental progressive award wager pool (e.g., the amount of the total increment remaining in the supplemental progressive award wager pool). In this example, the gaming system allocates the portion of the total increment remaining in the supplemental progressive award to the primary and supplemental progressive award wager pool, and because the gaming system could potentially provide a currently displayed value of a progressive award three times for a subsequent play of a triggered community game, the gaming system allocates $539.53 of the remaining amount of the total increment (i.e., $1,618.58) to the primary progressive award wager pool, and allocates $1,079.05 of the remaining amount of the total increment to the supplemental progressive award wager pool. In this example, at the point in time indicated by numeral 360, the gaming system determines a new start-up value of $6,000.00 to be allocated to the primary and the supplemental progressive award wager pools. At the point in time indicated by numeral 362, the gaming system allocates $2,000.00 of the $6,000.00 start-up value to the primary progressive award wager pool, and allocates $4,000.00 of the $6,000.00 start-up value to the supplemental progressive award wager pool, such that the primary progressive award wager pool has an initially displayed value of $2,593.53 (i.e., $593.53+$2,000.00=$2593.53) and the supplemental progressive award wager pool has an initial value of $5,079.05 (i.e., $1,079.05+$4,000.00=$5,079.05).

It should appreciated that, in different embodiments, the start-up value is predetermined, randomly determined, determined based on a generated symbol or symbol combination, determined based on a random determination by the central controller, determined based on a random determination by one or more gaming devices, determined based on the amount of coin-in accumulated in one or more pools, or determined based on any other suitable method or criteria.

It should be appreciated that, in different embodiments, the portion of the start-up value that the gaming system allocates the primary and the supplemental progressive award wager pools is predetermined, randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria.

In different embodiments, the amount of each wager the gaming system allocates is predetermined, randomly determined, determined based on a generated symbol or symbol combination, determined based on a random determination by the central controller, determined based on a random determination by one or more gaming devices, determined based on the status of one or more players (such as determined through a player tracking system), determined based on one or more side wagers placed, determined based on a player's primary game wager, determined based on time (such as the time of day), determined based on the amount of coin-in accumulated in one or more pools, or determined based on any other suitable method or criteria.

Figure 10:
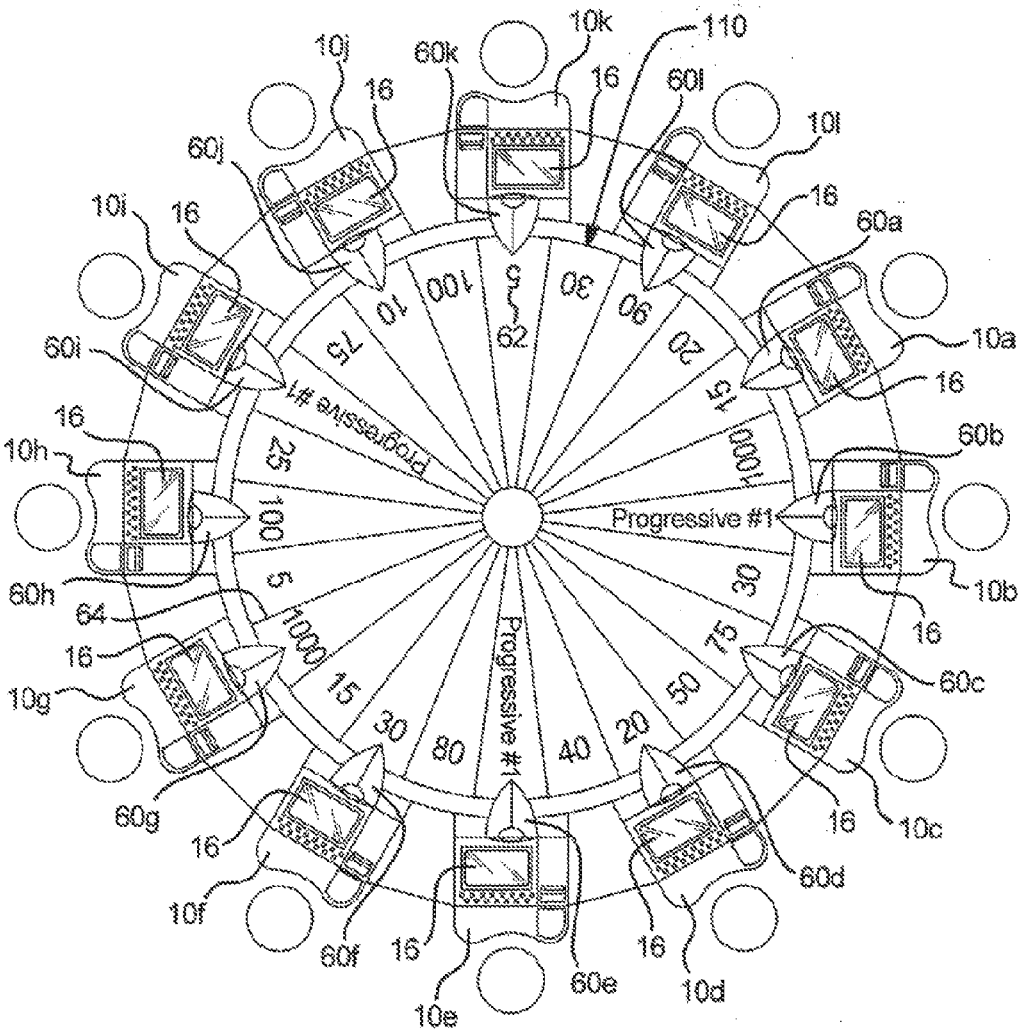
FIG. 10 is a perspective view of an alternative embodiment of the gaming system disclosed herein illustrating a plurality of gaming devices associated with a triggered community bonus game.

It should be appreciated that in different embodiments, for different community games, different awards are displayed in award areas of shared display element 110 of FIG. 10. In one embodiment, for different plays of a triggered community game a different quantity of award areas of shared display element 110 are associated with a progressive award. In another embodiment, the displayed value of a progressive award is different for different plays of the community game. In another embodiment, a plurality of different progressive award values are displayed in award areas of shared display element 110. In other words, for a first triggered community game, a first award area of shared display element 110 may be associated with a first progressive award having a first displayed value, and a second different, award area of shared display element 110 may be associated with a second, different progressive award having a second, different displayed value.

In another alternative embodiment, the gaming system designates a portion of each wager placed at each gaming device in the gaming system for incrementing the displayed value of the progressive award. In one such embodiment, the gaming system allocates an amount of this designated portion to incrementing the displayed value of the progressive award based on the quantity of gaming devices that can each potentially provide a displayed value of the progressive award to a player playing that gaming device. In other words, in this embodiment, the displayed value of the progressive award increments at a rate that is proportional to the quantity of gaming devices that can each potentially provide a displayed value of the progressive award to a player playing that gaming device. In another such embodiment, the gaming system allocates an amount of this designated portion to incrementing the displayed value of the progressive award based on the quantity of players that are each eligible to win a displayed value of the progressive award. In these embodiments, if a progressive award triggering event occurs, the gaming system provides a currently displayed value of the progressive award to a player playing a gaming device in the gaming system, and because a remaining portion of the amount that is designated to be provided as one or more progressive awards was not previously allocated to incrementing the displayed value of the triggered progressive award, the gaming system also provides that currently displayed value of the progressive award to one or more additional players playing one or more additional gaming devices in the gaming system. For example, five gaming devices in a gaming system could each potentially provide a displayed value of a progressive award. In this example, for every $1.00 that the gaming system designates for incrementing progressive awards, the gaming system allocates $0.20 to incrementing the displayed value of the progressive award. That is, in this example, the gaming system increments the currently displayed value of the progressive award by 20% of the amount allocated from each placed wager. In this example, if a progressive award triggering event occurs, the gaming system provides a currently displayed value of the triggered progressive award to the player that triggered that progressive award, and because 80% of the total amount designated for incrementing the values progressive awards is not included in the currently displayed value of the triggered progressive award, the additional four gaming devices in the gaming system could each potentially provide the currently displayed value of the triggered progressive award.

It should be appreciated that, in different embodiments, providing a currently displayed value of a progressive award to a plurality of players is implemented in accordance with the embodiments disclosed above, wherein a progressive award is associated with a plurality of progressive award hit values such that a plurality of displayed incremented values of a progressive award are provided a plurality of times before the currently displayed value of that progressive award is reset to a reset value. In other words, in different embodiments, in addition to providing a then currently displayed value of a progressive award to a plurality of players at least a first time, the displayed value of the progressive award continues to increment from the provided value.

In an alternative embodiment, a progressive award triggering event occurs (and a currently displayed value of a progressive award is provided to each of one or more players) based on an amount coin-in. In this embodiment, the gaming system determines if an amount of coin-in wagered at one or more gaming devices in the gaming system reaches or exceeds a designated amount of coin-in (i.e., a threshold coin-in amount). Upon the amount of coin-in wagered at one or more gaming devices in the gaming system reaching or exceeding the bonus threshold coin-in amount, the gaming system causes one or more of such events or conditions to occur. In different embodiments, the threshold coin-in amount is predetermined, randomly determined, determined based on a player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day) or determined based on any other suitable method or criteria.

In another alternative embodiment, a progressive award triggering event occurs (and a currently displayed value of a progressive award is provided to each of one or more players) based on an amount coin-out. In this embodiment, the gaming system determines if an amount of coin-out provided by one or more gaming devices in the gaming system reaches or exceeds a designated amount of coin-out (i.e., a threshold coin-out amount). Upon the amount of coin-out provided at one or more gaming devices in the gaming system reaching or exceeding the threshold coin-out amount, the gaming system causes one or more of such events or conditions to occur. In different embodiments, the threshold coin-out amount is predetermined, randomly determined, determined based on a player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day) or determined based on any other suitable method or criteria.

In another alternative embodiment, a progressive award triggering event occurs (and a currently displayed value of a progressive award is provided to each of one or more players) based on a predefined variable reaching a defined parameter threshold. For example, when the 500,000$^{th}$ player has played a gaming machine of the gaming system (ascertained from a player tracking system), one or more of such events or conditions occur. In different embodiments, the predefined parameter thresholds include a length of time, a length of time after a certain dollar amount is hit, a wager level threshold for a specific machine (which gaming device is the first to contribute $250,000), a number of gaming machines active, or any other parameter that defines a suitable threshold.

In another alternative embodiment, a progressive award triggering event occurs (and a currently displayed value of a progressive award is provided to each of one or more players) based on time. In this embodiment, a time is set for when one or more of such events or conditions will occur. In one embodiment, such a set time is based on historic data.

In another alternative embodiment, a progressive award triggering event occurs (and a currently displayed value of a progressive award is provided to each of one or more players) based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the central controller/gaming device processor recognizes the player's identification (via the player tracking system) when the player inserts or otherwise associates their player tracking card in the gaming machine. The central server/gaming device processor determines the player tracking level of the player and if the current player tracking level defined by the gaming system operator is eligible for one or more of such events or conditions. In one embodiment, the gaming system operator defines minimum bet levels required for such events or conditions to occur based on the player's card level.

In another alternative embodiment, a progressive award triggering event occurs (and a currently displayed value of a progressive award is provided to each of one or more players) based on a system determination, including one or more random selections by the central controller. In one embodiment, as described above, the central controller tracks all active gaming machines and the wagers they placed. In one such embodiment, based on the gaming machine's state as well as one or more wager pools associated with the gaming machine, the central controller determines whether to one or more of such events or conditions will occur. In one such embodiment, the player who consistently places a higher wager is more likely to be associated with an occurrence of one or more of such events or conditions than a player who consistently places a minimum wager. It should be appreciated that the criteria for determining whether a player is in active status or inactive status for determining if one or more of such events occur may the same as, substantially the same as, or different than the criteria for determining whether a player is in active status or inactive status for another one of such events to occur.

In another alternative embodiment, a progressive award triggering event occurs (and a currently displayed value of a progressive award is provided to each of one or more players) based on a determination of if any numbers allotted to a gaming device match a randomly selected number. In this embodiment, upon or prior to each play of each gaming machine, a gaming device selects a random number from a range of numbers and during each primary game, the gaming machine allocates the first N numbers in the range, where N is the number of credits bet by the player in that primary game. At the end of the primary game, the randomly selected number is compared with the numbers allocated to the player and if a match occurs, one or more of such events or conditions occur.

It should be appreciated that any suitable manner of causing one or more bonus event elements to be provided may be implemented in accordance with the gaming system and method disclosed herein.

Information Provided to Player

As indicated above, suitable information about the progressive award triggering event and/or a resetting of the displayed value of a progressive award can be provided to the players through one or more displays on the gaming machines or additional information displays positioned near the gaming machines, such as above a bank of system gaming machines. In one embodiment, a metering and/or information display device may be used to display information regarding the progressive award triggering events. This information can be used to entertain the player or inform the player that progressive award triggering event has occurred or will occur. Examples of such information are:

(1) that a progressive award triggering event has occurred;

(2) that a progressive award triggering event will shortly occur, (3) that one or more progressive awards have been provided to one or more players of the system of gaming machines;

(4) the total quantity of progressive awards to be provided before the displayed value of the progressive award is reset to a reset value;

(5) number of games played/total time since the last progressive award triggering event has occurred;

(6) an average amount of time between each progressive award triggering event occurring;

(7) that a progressive award triggering event has occurred;

(8) an award provided in association with progressive award triggering event;

(9) which players have won awards in association with a progressive award triggering event;

(10) the amount of the awards won in association with a progressive award triggering event;

(11) the highest award won in association with a progressive award triggering event;

(12) the average award won in association with a progressive award triggering event; and

(13) that a displayed value of a progressive award has been reset to a reset value;

(14) that a displayed value of a progressive award will be reset to a reset value shortly,

(15) the number of games played/total time since the last displayed value of a progressive award has been reset to a reset value;

(16) an average amount of time between the displayed value of each progressive award being reset to a reset value;

(17) an award provided in association with the displayed value of a progressive award being reset to a reset value;

(18) which players have won awards in association with a displayed value of a progressive award being reset to a reset value;

(19) the amount of the awards won in association with a displayed value of a progressive award being reset to a reset value;

(20) the highest award won in association with a displayed value of a progressive award being reset to a reset value;

(21) the average award won in association with a displayed value of a progressive award being reset to a reset value; and It should be appreciated that such information can be provided to the players through any suitable audio, audio-visual or visual devices.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a plurality of gaming devices, each gaming device including at least one input device;

at least one display device associated with at least one of said gaming devices; and at least one controller configured to operate with each of said gaming devices and said at least one display device to:

(a) maintain a progressive award having a reset value, said progressive award associated with a designated quantity of at least two occurrences of a progressive award triggering event;

(b) display a current value of said progressive award; (c) for each of said gaming devices, enable a player of said gaming device to place a wager to play a primary game;

(d) upon a progressive award increase event, increment the displayed value of said progressive award; and (e) when a progressive award triggering event occurs:

(i) cause one of the gaming devices to provide a currently displayed value of said progressive award, (ii) increment a tracked quantity of occurrences of the progressive award triggering event, (iii) if the tracked quantity of occurrences of the progressive award triggering event equals the designated quantity of at least two occurrences of the progressive award triggering event:

(A) reset the displayed value of said progressive award to said reset value, and (B) reset the tracked quantity of occurrences of the progressive award triggering event to a reset quantity, and (iv) if the tracked quantity of occurrences of the progressive award triggering event is less than the designated quantity of at least two occurrences of the progressive award triggering event, repeat steps (c) to (e) at least once, wherein the displayed value of said progressive award continues to increment from said provided value of said progressive award.

2. The gaming system of claim 1, wherein said progressive award is associated with at least two progressive award hit values and the at least one controller is configured to operate with each of said gaming devices and said at least one display device to cause the progressive award triggering event to occur each time the value of said progressive award has incremented to one of the progressive award hit values.

3. The gaming system of claim 1, wherein the at least one controller is configured to operate with each of said gaming devices and said at least one display device to cause the progressive award triggering event to occur each time a designated primary game outcome is generated in one of the plays of the primary game.

4. The gaming system of claim 3, wherein the designated primary game outcome includes a designated symbol combination.

5. The gaming system of claim 1, wherein the progressive award triggering event includes a plurality of different progressive award triggering events and the at least one controller is configured to operate with each of said gaming devices and said at least one display device to increment the tracked quantity of occurrences of the progressive award triggering event each time any of the different progressive award triggering events occur.

6. The gaming system of claim 1, wherein the progressive award increase event occurs based on at least one placement of the wager to play the primary game.

7. A gaming system comprising:

a plurality of gaming devices, each gaming device including at least one input device;

at least one display device associated with at least one of said gaming devices; and at least one controller configured to operate with each of said gaming devices and said at least one display device to:

(a) maintain a progressive award having a reset value, (b) display a current value of said progressive award;

(c) upon a first occurrence of a progressive award triggering event:

(i) cause a first one of the gaming devices to provide a first currently displayed value of said progressive award to a player playing said first one of the gaming devices, and (ii) continue to increment the displayed value of said progressive award from said provided first currently displayed value of said progressive award upon a subsequent progressive award increase event; and (d) upon a second occurrence of the progressive award triggering event, cause a second one of the gaming devices to provide a second currently displayed value of said progressive award to a player playing said second one of the gaming devices.

8. The gaming system of claim 7, wherein the first gaming device and the second gaming device are the same gaming device.

9. The gaming system of claim 7, wherein the displayed value of the progressive award increments based on a placement of a wager.

10. The gaming system of claim 7, wherein said progressive award is associated with at least two progressive award hit values and the at least one controller is configured to operate with each of said gaming devices and said at least one display device to cause the progressive award triggering event to occur each time the value of said progressive award has incremented to one of the progressive award hit values.

11. The gaming system of claim 7, wherein the at least one controller is configured to operate with each of said gaming devices and said at least one display device to cause the progressive award triggering event to occur each time a designated primary game outcome is generated in one of the plays of the primary game.

12. The gaming system of claim 11, wherein the designated primary game outcome includes a designated symbol combination.

13. A method of operating a gaming system, said method comprising:

(a) causing at least one processor to execute a plurality of instructions to maintain a progressive award having a reset value, said progressive award associated with a designated quantity of at least two occurrences of a progressive award triggering event;

(b) causing at least one display device to display a current value of said progressive award;

(c) for each of a plurality of gaming devices, enabling a player of said gaming device to place a wager to play a primary game;

(d) upon a progressive award increase event, causing the at least one processor to execute the plurality of instructions to increment the displayed value of said progressive award; and (e) when a progressive award triggering event occurs:

(i) causing the at least one processor to execute the plurality of instructions to cause one of the gaming devices to provide a currently displayed value of said progressive award, (ii) causing the at least one processor to execute the plurality of instructions to increment a tracked quantity of occurrences of the progressive award triggering event, (iii) if the tracked quantity of occurrences of the progressive award triggering event equals the designated quantity of at least two occurrences of the progressive award triggering event:

(A) causing the at least one processor to execute the plurality of instructions to reset the displayed value of said progressive award to said reset value, and (B) causing the at least one processor to execute the plurality of instructions to reset the tracked quantity of occurrences of the progressive award triggering event to a reset quantity, and (iv) if the tracked quantity of occurrences of the progressive award triggering event is less than the designated quantity of at least two occurrences of the progressive award triggering event, repeating steps (c) to (e) at least once, wherein the displayed value of said progressive award continues to increment from said provided value of said progressive award.

14. The method of claim 13, which includes causing the at least one processor to execute the plurality of instructions to cause the progressive award triggering event to occur each time the value of said progressive award has incremented to one of at least two progressive award hit values associated with the progressive award.

15. The method of claim 13, which includes causing the at least one processor to execute the plurality of instructions to cause the progressive award triggering event to occur each time a designated primary game outcome is generated in one of the plays of the primary game.

16. The method of claim 15, wherein the designated primary game outcome includes a designated symbol combination.

17. The method of claim 13, which includes causing the at least one processor to execute the plurality of instructions to increment the tracked quantity of occurrences of the progressive award triggering event each time any of a plurality of different progressive award triggering events associated with the progressive award occur.

18. The method of claim 13, wherein the progressive award increase event occurs based on at least one placement of the wager to play the primary game.

19. The method of claim 13, which is provided through a data network.

20. The method of claim 19, wherein the data network is an internet.

21. A method of operating a gaming system, said method comprising:

(a) causing at least one processor to execute a plurality of instructions to maintain a progressive award having a reset value, (b) causing at least one display device to display a current value of said progressive award;

(c) upon a first occurrence of a progressive award triggering event:

(i) causing the at least one processor to execute the plurality of instructions to cause a first one of a plurality of gaming devices to provide a first currently displayed value of said progressive award to a player playing said first one of the gaming devices, and (ii) causing the at least one processor to execute the plurality of instructions to continue to increment the displayed value of said progressive award from said provided first currently displayed value of said progressive award upon a subsequent progressive award increase event; and (d) upon a second occurrence of the progressive award triggering event, causing the at least one processor to execute the plurality of instructions to cause a second one of the gaming devices to provide a second currently displayed value of said progressive award to a player playing said second one of the gaming devices.

22. The method of claim 21, wherein the first gaming device and the second gaming device are the same gaming device.

23. The method of claim 21, wherein the displayed value of the progressive award increments based on a placement of a wager.

24. The method of claim 21, which includes causing the at least one processor to execute the plurality of instructions to cause the progressive award triggering event to occur each time the value of said progressive award has incremented to one of at least two progressive award hit values associated with the progressive award.

25. The method of claim 21, which includes causing the at least one processor to execute the plurality of instructions to cause the progressive award triggering event to occur each time a designated primary game outcome is generated in one of the plays of the primary game.

26. The method of claim 25, wherein the designated primary game outcome includes a designated symbol combination.

27. The method of claim 21, which is provided through a data network.

28. The method of claim 27, wherein the data network is an internet.

* * * * *

UNITED STATES PATENT AND TRADEMARK OFFICE

CERTIFICATE OF CORRECTION

PATENT NO. : 8,545,316 B2
APPLICATION NO. : 13/432468
DATED : October 1, 2013
INVENTOR(S) : Jason P. Pawloski et al.

It is certified that error appears in the above-identified patent and that said Letters Patent is hereby corrected as shown below:

IN THE CLAIMS

In Claim 1, Column 47, Line 10, replace “a” with --the--.
In Claim 11, Column 48, Lines 34 to 35, replace “one of the plays” with --a play--.
In Claim 11, Column 48, Line 35, replace “the” with --a--.
In Claim 13, Column 48, Line 55, replace “a” with --the--.
In Claim 25, Column 50, Lines 37 to 38, replace “one of the plays” with --a play--.
In Claim 25, Column 50, Line 38, replace “the” with --a--.

Signed and Sealed this
Second Day of June, 2015

Michelle K. Lee

Michelle K. Lee
*Director of the United States Patent and Trademark Office*